US010648261B2

(12) United States Patent
Hardy et al.

(10) Patent No.: US 10,648,261 B2
(45) Date of Patent: May 12, 2020

(54) CIRCULATION SUBASSEMBLY

(71) Applicant: INTELLIGENT DRILLING TOOLS LIMITED, Sheffield South Yorkshire (GB)

(72) Inventors: James Hardy, Sheffield (GB); Mark Booth, Sheffield (GB); Andrew Ollerenshaw, Sheffield (GB); Gordon Hunter, Kinross (GB)

(73) Assignee: Intelligent Drilling Tools Limited, Sheffield South Yorkshire (GB)

( * ) Notice: Subject to any disclaimer, the term of this patent is extended or adjusted under 35 U.S.C. 154(b) by 0 days.

(21) Appl. No.: 15/773,844

(22) PCT Filed: Nov. 7, 2016

(86) PCT No.: PCT/GB2016/053479

§ 371 (c)(1),
(2) Date: May 4, 2018

(87) PCT Pub. No.: WO2017/077345

PCT Pub. Date: May 11, 2017

(65) Prior Publication Data

US 2018/0328129 A1 Nov. 15, 2018

(30) Foreign Application Priority Data

Nov. 6, 2015 (GB) ..... 1519684.3
Aug. 2, 2016 (GB) ..... 1613332.4

(51) Int. Cl.
*E21B 21/10* (2006.01)
*E21B 23/00* (2006.01)
(Continued)

(52) U.S. Cl.
CPC ..... *E21B 21/103* (2013.01); *E21B 21/10* (2013.01); *E21B 23/006* (2013.01); *E21B 34/14* (2013.01); *E21B 2034/002* (2013.01)

(58) Field of Classification Search
CPC .. E21B 2034/002; E21B 21/10; E21B 21/103; E21B 23/006; E21B 34/14
See application file for complete search history.

(56) References Cited

U.S. PATENT DOCUMENTS 6,378,612 B1 * 4/2002 Churchill ..... E21B 21/103 166/319
9,255,466 B2 2/2016 Javed
(Continued)

FOREIGN PATENT DOCUMENTS

CN 202249949 5/2012
CN 202249949 U 5/2012
(Continued)

OTHER PUBLICATIONS

International Preliminary Report on Patentability dated May 17, 2018, from International Application No. PCT/GB2016/053479, 11 pages.

(Continued)

*Primary Examiner* — James G Sayre
(74) *Attorney, Agent, or Firm* — Meunier Carlin & Curfman LLC

(57) ABSTRACT

The present invention relates to acirculation subassembly (circsub) for incorporation in a drill pipe. The circsub has a flow through condition in which the circsub allows fluid to flow through a bore of the circsub and does not allow fluid communication between the bore of the circsub and an annulus located outside the drill pipe, a partial bypass condition in which the circsub allows fluid to flow through the bore of the circsub and allows fluid communication between the bore of the circsub and the annulus, and a full bypass condition in which the circsub does not allow fluid to flow through the bore of the circsub and allows fluid communication between the bore of the circsub and the annulus. An actuator is provided to change the circsub between conditions under the control of a controller.

33 Claims, 17 Drawing Sheets

(51) Int. Cl.
*E21B 34/14* (2006.01)
*E21B 34/00* (2006.01)

(56) References Cited

U.S. PATENT DOCUMENTS

| | | | | |
|---|---|---|---|---|
| 2009/0095486 | A1 | 4/2009 | Williamson | |
| 2010/0270034 | A1 | 10/2010 | Clausen | |
| 2011/0308784 | A1* | 12/2011 | Ollerenshaw | E21B 17/06 166/72 |
| 2012/0018172 | A1 | 1/2012 | Javed | |
| 2014/0014360 | A1 | 1/2014 | Wilson | |
| 2014/0131029 | A1 | 5/2014 | Harms et al. | |
| 2016/0017690 | A1* | 1/2016 | Baudoin | E21B 23/006 166/318 |

FOREIGN PATENT DOCUMENTS

| | | | |
|---|---|---|---|
| WO | 2012006457 | A1 | 1/2012 |
| WO | 2017077345 | A1 | 5/2017 |

OTHER PUBLICATIONS

International Search Report and Written Opinion dated Feb. 1, 2017, from International Application No. PCT/GB2016/053479, 12 pages.

* cited by examiner

CIRCULATION SUBASSEMBLY

This invention relates to circulation subassemblies employed in the oil and gas drilling industry.

BACKGROUND

It is known to provide circulation subassemblies (circsubs) in drill pipes in the oil and gas industry. Such circsubs allow drilling fluid that is pumped down the drill pipe to bypass the bottom hole assembly (BHA) by providing an opening that can selectively allow fluid communication between the bore of the drill pipe and the annulus between the drill pipe and the well bore. This may be useful if an operator wishes to clean part of the annulus with drilling fluid at high flow rate. It may also be useful for introducing lost circulation material (LCM) to seal the well bore and prevent loss of drilling fluid. It is undesirable to introduce LCM around the BHA, as this may cause the BHA to become stuck.

Known circsubs may be actuated by a variety of different methods, including by passing a dart or a ball down the bore of the drill pipe. However, this method has the disadvantage that the darts or balls can often only be passed down the bore of the drill string when drilling fluid is able to flow down the drill pipe.

Some circsubs only allow partial bypass of the BHA. That is, they selectively allow or prevent fluid communication between the bore of the drill pipe and the annulus between the drill pipe and the well bore, but they cannot prevent fluid communication between the bore of the drill pipe above the circsub and the BHA. It is desirable to provide the possibility of both full bypass in which fluid communication between the bore of the drill pipe and the BHA is prevented but fluid communication between the bore of the drill pipe and the annulus is allowed and partial bypass. However, this increases complexity.

A known circsub, which is available from Drilling Systems International (DSI) under the trade name PBL® Sub, is operable to provide full bypass of a BHA. It is placed in the full bypass condition by passing a vinyl ball down the bore of the drill pipe. The tool can be returned to the flow through condition by inserting deactivation balls to block the bypass holes and increasing the pressure to a predetermined value, which causes the vinyl ball to shear and move through the circsub to a catcher assembly. The deactivation balls also move through the circsub to the catcher assembly. A disadvantage of this arrangement is that transitions between conditions can only be made when drilling fluid is able to flow through the circsub, and the number of transitions that are possible before the circsub must be removed from the well bore is limited by the space available to store used balls.

The present invention seeks to at least partially mitigate the problems identified with the prior art.

BRIEF SUMMARY OF THE DISCLOSURE

In accordance with an aspect of the present invention there is provided a circulation subassembly (circsub) for incorporation in a drill pipe, the circsub comprising a piston movable within a bore of the circsub in a first direction by pressure of fluid within said bore, the piston having:

a first position corresponding to a flow through condition of the circsub in which the circsub allows fluid to flow through a bore of the circsub and does not allow fluid flow from the bore of the circsub through bypass orifices in the circsub into an annulus located outside the drill pipe;

a second position corresponding to a partial bypass condition of the circsub in which the circsub allows fluid to flow through the bore of the circsub and allows fluid communication through said bypass orifices from the bore of the circsub into the annulus; and a third position corresponding to a full bypass condition of the circsub in which the circsub does not allow fluid to flow through the bore of the circsub and allows fluid communication through said bypass orifices from the bore of the circsub into the annulus, wherein the circsub further comprises biasing means for biasing the piston in a second direction opposite to the first direction, and a selectively adjustable abutment for limiting the movement of the piston in said first direction to each of said first, second and third positions.

It will be understood that the piston may be substantially hollow, and at least part of the bore of the circsub may be a bore of the piston. An outer surface of the piston may be in contact with an inner surface of an outer body of the circsub.

A circsub produced in accordance with this aspect may allow an operator to change between the flow through, partial bypass and full bypass conditions without inserting a dart or a ball into the drill pipe. Accordingly, transitions between conditions may be made when flow in the drill pipe or the annulus is blocked, and a large number of transitions may be possible without the need for the circsub to return to the surface.

In accordance with another aspect of the invention there is provided a circulation subassembly (circsub) for incorporation in a drill pipe, the circsub comprising a piston movable within a bore of the circsub in a first direction by pressure of fluid within said bore, the piston having: a position corresponding to a flow through condition of the circsub in which the circsub allows fluid to flow through a bore of the circsub and does not allow fluid flow from the bore of the circsub through bypass orifices in the circsub into an annulus located outside the drill pipe; and a position corresponding to a full bypass condition of the circsub in which the circsub does not allow fluid to flow through the bore of the circsub and allows fluid communication through said bypass orifices from the bore of the circsub into the annulus, wherein the circsub further comprises biasing means for biasing the piston in a second direction opposite to the first direction, and a selectively adjustable abutment for limiting the movement of the piston in said first direction to each of said positions.

In an embodiment the circsub further comprises an electronic controller and an actuator operable to move the adjustable abutment, the controller being operable:

in response to receipt of a first signal, to control the actuator to move the adjustable abutment so as to stop movement of the piston when the piston is in the first position;

in response to receipt of a second signal, to control the actuator to move the adjustable abutment so as to stop movement of the piston when the piston is in the second position; and in response to receipt of a third signal, to control the actuator to move the adjustable abutment so as to stop movement of the piston when the piston is in the third position. In some embodiments the controller may be electrically powered by a power source that is separate from surface level when the circulation subassembly is in use in a drill pipe. For example, one or more batteries may be used to power the controller.

In an embodiment the adjustable abutment is configured to be automatically moved once the pressure falls below a threshold value. Optionally, the circsub further comprises a barrel cam and follower which causes relative rotation between the adjustable abutment and the piston when the pressure of fluid in the circsub rises and falls below the threshold value.

Optionally, the adjustable abutment comprises a first castellated surface and a second castellated surface, one of which is defined on the piston, wherein the actuator may be configured to move the first castellated surface relative to the second castellated surface, thereby to effect the transitions between the flow through condition, the partial bypass condition and the full bypass condition. Preferably, the adjustable abutment comprises a sleeve on which the first castellated surface is defined, wherein movement of the castellated surface comprises rotation of the sleeve.

In some embodiments the actuator may comprise a motor configured to rotate the sleeve. Alternatively, the actuator may comprise one or more controllable valves operable to move the adjustable abutment by allowing or preventing flow of pressurised fluid into one or more actuation channels.

The biasing means may comprise a spring.

In some embodiments the circsub further comprises a first sensor in communication with the controller, the first sensor being configured to detect mechanical signals transmitted through the drill pipe from surface level, wherein the first, second and third signals correspond to predetermined mechanical signals being detectable by said first sensor.

Optionally, the first sensor may comprise one or more accelerometers. Use of mechanical signals may obviate the need for an electrical connection between the circsub and a user interface located at surface level. Furthermore, in embodiments where the actuator and the controller are powered by a power source that is separate from surface level when the circsub is in use it may be unnecessary to provide any electrical connection between the circsub and components located at surface level.

Further optionally, the first signal may correspond to a first predetermined mechanical signal being received when the circsub is in the full bypass condition, the second signal corresponds to a second predetermined mechanical signal being received when the circsub is in the flow through condition and the third signal corresponds to a third predetermined mechanical signal being received when the circsub is in the partial bypass condition, optionally wherein the first, second and third predetermined mechanical signals are the same as each other. Accordingly, the first controller may only be required to recognize a single predetermined signal, and the condition to which the controller changes the circsub in response to detecting the predetermined signal may depend on the condition of the circsub when the signal is received.

Optionally, the circsub further comprises a pressure sensor in communication with the controller, the pressure sensor being configured to detect a pressure in the bore of the circsub, wherein the controller is configured to prevent transitions between the flow through, partial bypass and full bypass conditions when the pressure measured by the pressure sensor is above a first threshold value. This may prevent the controller from attempting to actuate a change in condition of the circsub before the operator has reduced the pressure to the level at which transitions are expected to take place.

In some embodiments the circsub further comprises a proximity sensor in communication with the controller, the proximity sensor being configured to detect a position of a piston of the circsub, wherein the controller is configured to prevent transitions between the flow through, partial bypass and full bypass conditions in dependence on the position of the piston. This may prevent the controller from attempting to actuate a change in condition of the circsub when the castellated surfaces abut each other.

In some embodiments the circsub may comprise a valve having an open condition in which flow through the bore of the circsub is allowed and a closed condition in which flow through the bore of the circsub is substantially prevented, wherein the valve is configured to assume the open condition when the circsub is in the flow through condition or the partial bypass condition and to assume the closed condition when the circsub is in the full bypass condition. Optionally, the valve may be a ball valve. Optionally, the valve may completely prevent flow through the bore of the circsub when it is in the closed condition.

In some embodiments the valve is located within the circsub by a frangible abutment, wherein the frangible abutment is configured to break when the valve is in the closed condition and the pressure in the bore of the circsub is greater than a second threshold value, the valve being configured to move within the circsub to a position at which drilling fluid may flow around the valve when the frangible abutment breaks. This may prevent, or at least delay, a requirement for the circsub to return to surface level if the mechanism that actuates the ball valve fails while the circsub is in use.

The frangible abutment may be a frangible shear ring.

In some embodiments, the valve is a ball valve and grooves are provided on an inner surface of the bore of the circsub, said grooves being configured to facilitate movement of drilling fluid around the ball valve when the ball valve has moved to the position at which drilling fluid may flow around the ball valve in response to the frangible abutment breaking.

In some embodiments the circsub comprises a conduit between the bore of the circsub and the annulus, the conduit being closed when the circsub is in the flow through condition, opened to a first extent when the circsub is in the partial bypass condition and opened to a second extent when the circsub is in the full bypass condition, wherein opening the conduit to the second extent provides a lower resistance to flow between the bore of the circsub and the annulus than opening the conduit to the first extent.

According to another embodiment said bypass orifices comprise a first set of one or more bypass orifices, a second set of one or more bypass orifices and a third set of one or more bypass orifices, wherein:

when the piston is in the second position the first set of bypass orifices and not the second set of bypass orifices are aligned with the third set of bypass orifices, thereby allowing fluid communication between the bore and the annulus;

when the piston is in the third position the second set of bypass orifices and not the first set of bypass orifices are aligned with the third set of bypass orifices, thereby allowing fluid communication between the bore and the annulus. This allows the resistance to flow between the bore and the annulus to be independently tuned for the partial bypass and full bypass positions.

Optionally, the resistance to flow from the bore to the annulus when the piston is in the partial bypass position may be greater than the resistance to flow from the bore to the annulus when the piston is in the full bypass position. This may be achieved, for example, by making the area available for flow through the first set of orifices smaller than the area available for flow through the second set of orifices.

An advantage of the above arrangement is that a clear pressure pulse may be observable when the piston arrives at the third position and the second and third sets of orifices align with one another. It will be understood that it may only be possible for fluid in the bore to flow into the annulus via the bypass orifices when either the first or second set of orifices is aligned with the third set of orifices.

Within the scope of this application two sets of orifices are considered to be "aligned" with one another if they at least partially overlap so that a fluid path is provided through the aligned orifices. Optionally, one or more seals may be provided to prevent fluid communication between the first and/or second sets of orifices and the third set of orifices when the first and/or second sets of orifices are not aligned with the third set of orifices.

Another advantage of the above embodiment is that the first and second sets of orifices may not be aligned with the third set of orifices for at least a portion of the movement of the piston from the partial bypass position to the full bypass position. This may reduce the amount of fluid power required to move the piston from the partial bypass position to the full bypass position, as it obviates the requirement to pump fluid into the annulus while the piston moves from the partial bypass position to the full bypass position.

In an embodiment the first and second sets of orifices may be located in the piston and the third set of orifices may be located in an outer body of the circsub. Alternatively, the first and second sets of orifices may be located in the outer body of the circsub and the third set of orifices may be located in the piston.

Some of the orifices may alternatively be referred to as nozzles.

In an embodiment the valve is configured to assume the closed condition when the piston is at an intermediate position between the partial bypass position and the full bypass position. This prevents fluid from flowing down the bore when the piston is between the intermediate position and the full bypass position, which may reduce the amount of fluid power required to move the piston from the partial bypass position to the full bypass position, because it prevents flow through the bore when the piston is between the intermediate position and the full bypass position.

In another embodiment said bypass orifices comprise one or more bypass orifices located in said piston and one or more bypass orifices located in an outer body of the circsub, wherein the bypass orifices located in said piston at least partially overlap the bypass orifices in the outer body when the piston is in said second and third positions.

According to another aspect of the present invention there is provided a circulation subassembly (circsub) for incorporation in a drill pipe, the circsub having:

a flow through condition in which the circsub allows fluid to flow through a bore of the circsub and does not allow fluid communication between the bore of the circsub and an annulus located outside the drill pipe;

a partial bypass condition in which the circsub allows fluid to flow through the bore of the circsub and allows fluid communication between the bore of the circsub and the annulus; and a full bypass condition in which the circsub does not allow fluid to flow through the bore of the circsub and allows fluid communication between the bore of the circsub and the annulus, wherein the circsub comprises a controller and an actuator, the controller being operable:

to control the actuator to transition the circsub to the flow through condition in response to receipt of a first signal;

to control the actuator to transition the circsub to the partial bypass condition in response to receipt of a second signal; and to control the actuator to transition the circsub to the full bypass condition in response to receipt of a third signal. The controller may comprise a processor connected to and electronic memory.

According to another aspect of the present invention there is provided a method of operating a circsub as described above, wherein transitions between the flow through, partial bypass and full bypass conditions are effected by sequentially:

reducing the pressure of fluid within said bore to a value at which the piston no longer abuts the adjustable abutment;

moving the selectively adjustable abutment; and increasing the pressure to a value at which further movement of the piston is limited by the piston abutting the adjustable abutment.

According to another aspect of the present invention there is provided a valve assembly for controlling flow of fluid through a bore of a piston, the assembly comprising a valve having a first condition and a second condition, an actuation assembly for changing the valve between the first condition and the second condition, the piston, and a sleeve in which the piston is located, wherein:

the piston is movable to a first position, a second position and a third position relative to the sleeve, the second position being between the first and third positions;

when the piston is moved from the second position to the third position the actuation assembly causes the valve to change from the first condition to the second condition;

when the piston is moved from the third position to the second position the actuation assembly causes the valve to change from the second condition to the first condition; and the actuation assembly does not change the condition of the valve when piston is moved from the second position to the first posit In an embodiment the first condition is an open condition in which the valve allows fluid to flow through the bore of the piston and the second condition is a closed condition in which the valve does not allow fluid to flow through the bore of the piston.

Optionally the valve is a ball valve.

In an embodiment the movement of the piston relative to the sleeve comprises translation.

In an embodiment the actuation assembly may comprise a control arm and a key, wherein:

movement of the control arm relative to the piston causes the valve to change between the first condition to the second condition;

when the piston is in the first position or the second position the key is located between a recess in the control arm and a recess in the piston, thereby preventing relative movement between the control arm and the piston;

movement of piston from the second position to the third position causes the key to move within the recess in the control arm to a position in which the key is located between the recess in the control arm and a recess in the sleeve and subsequently causes the control arm to move relative to the piston; and movement of piston from the third position to the second position causes the control arm to move relative to the piston and subsequently causes the key to move within the recess in the control arm to a position in which the key is located between the recess in the control arm and the recess in the piston.

The key may have one or more cam surfaces, which cam surfaces are configured to cause the key to move within the recess in the control arm when the piston is moved between the second position and the third position.

In an embodiment there is provided a circsub as described above comprising a valve assembly as described above.

BRIEF INTRODUCTION OF THE DRAWINGS

An embodiment of the invention is further described hereinafter, by way of example, with reference to the accompanying drawings, in which.

Figure 10A:
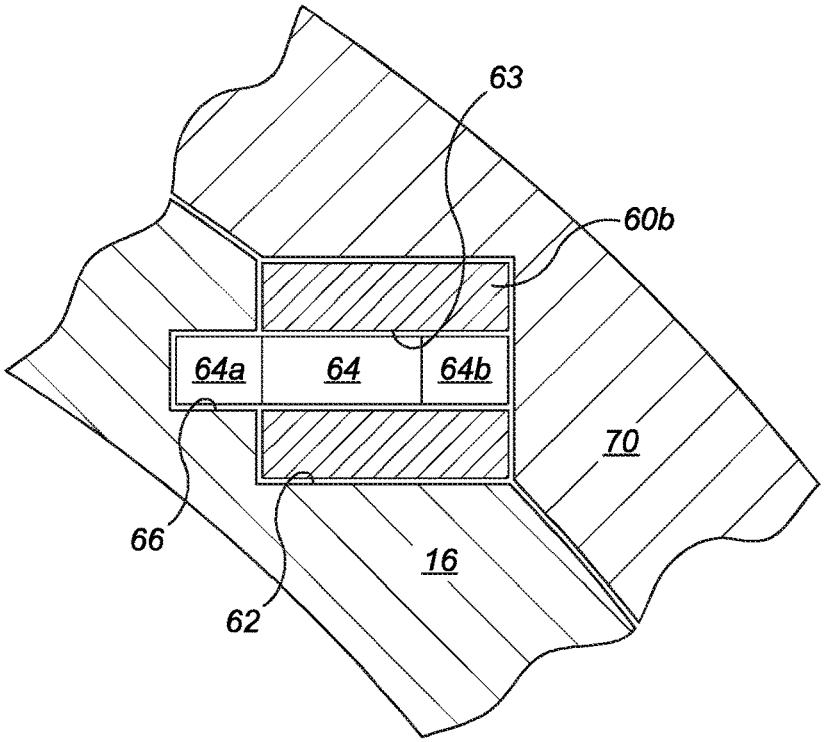
Figure 10B:
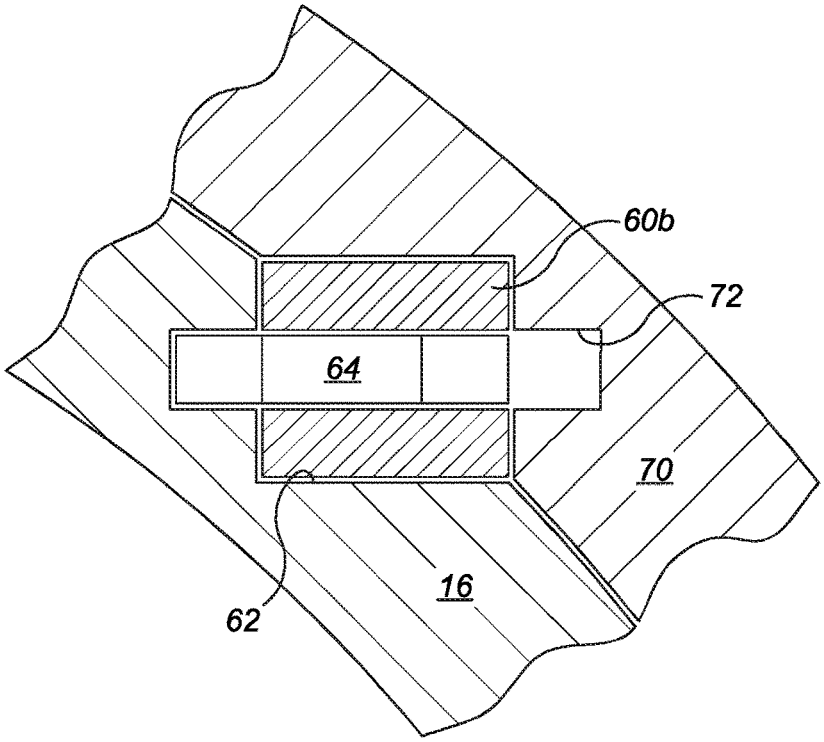
Figure 10C:
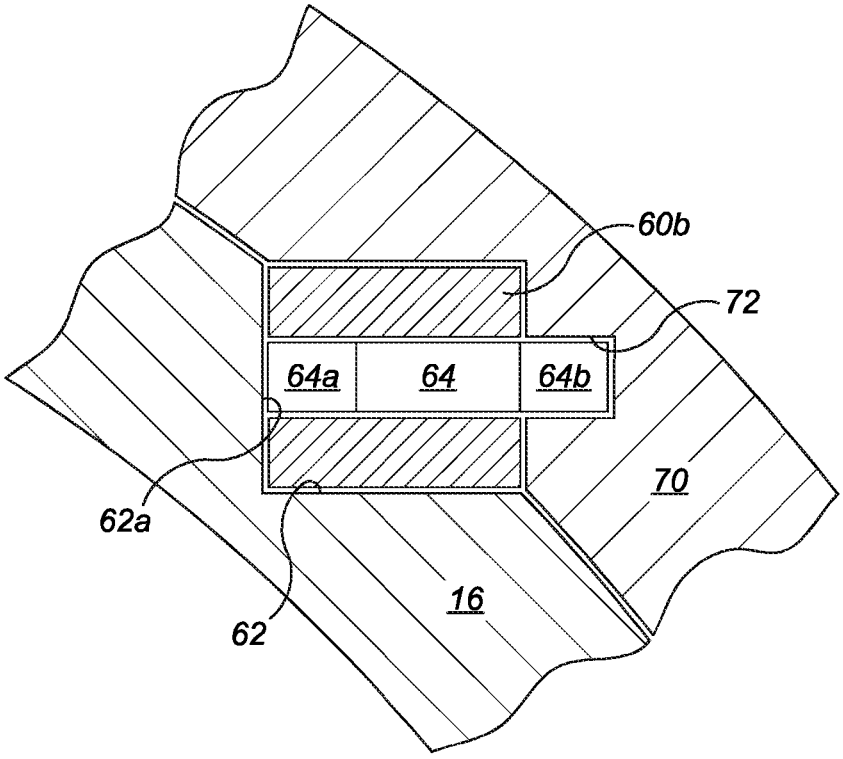
Figure 11:
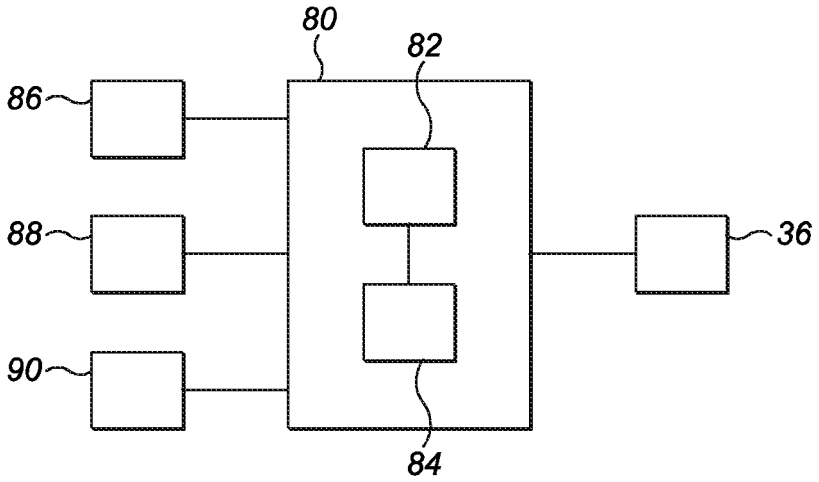
Figure 12:
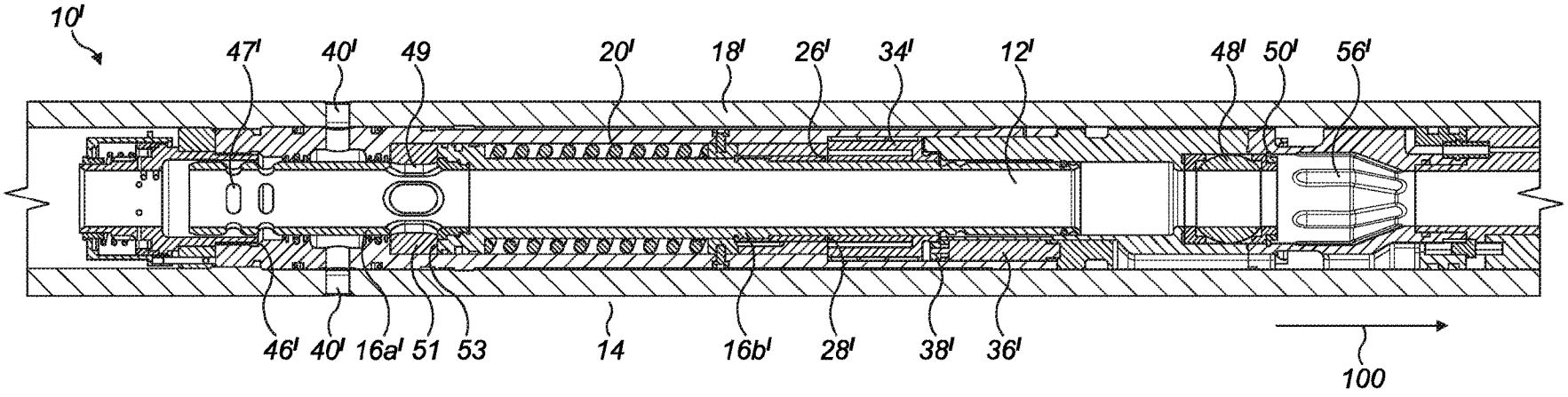
Figure 13:
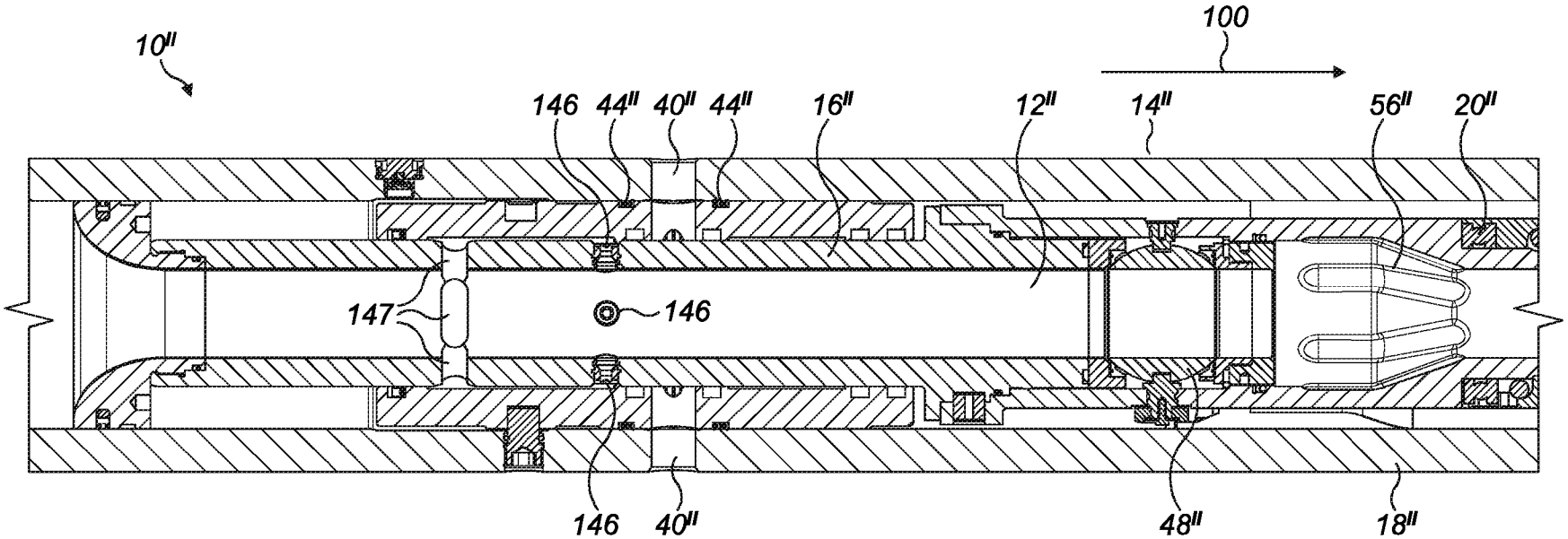
Figure 14:
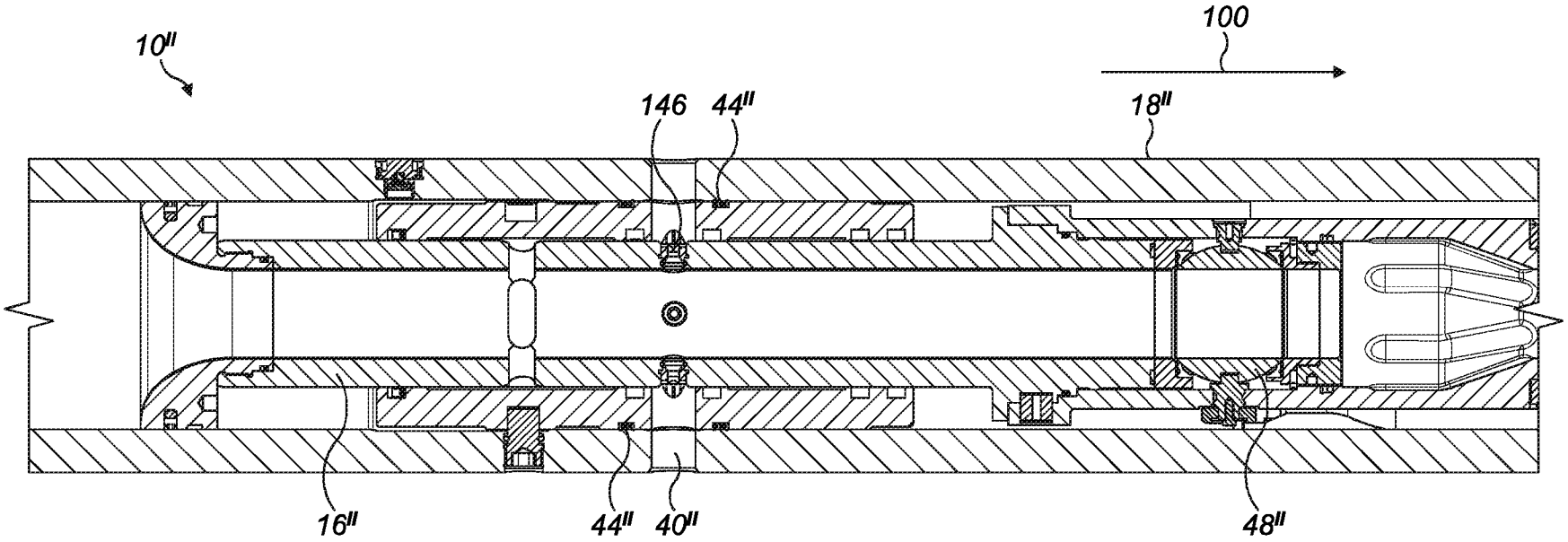
Figure 15:
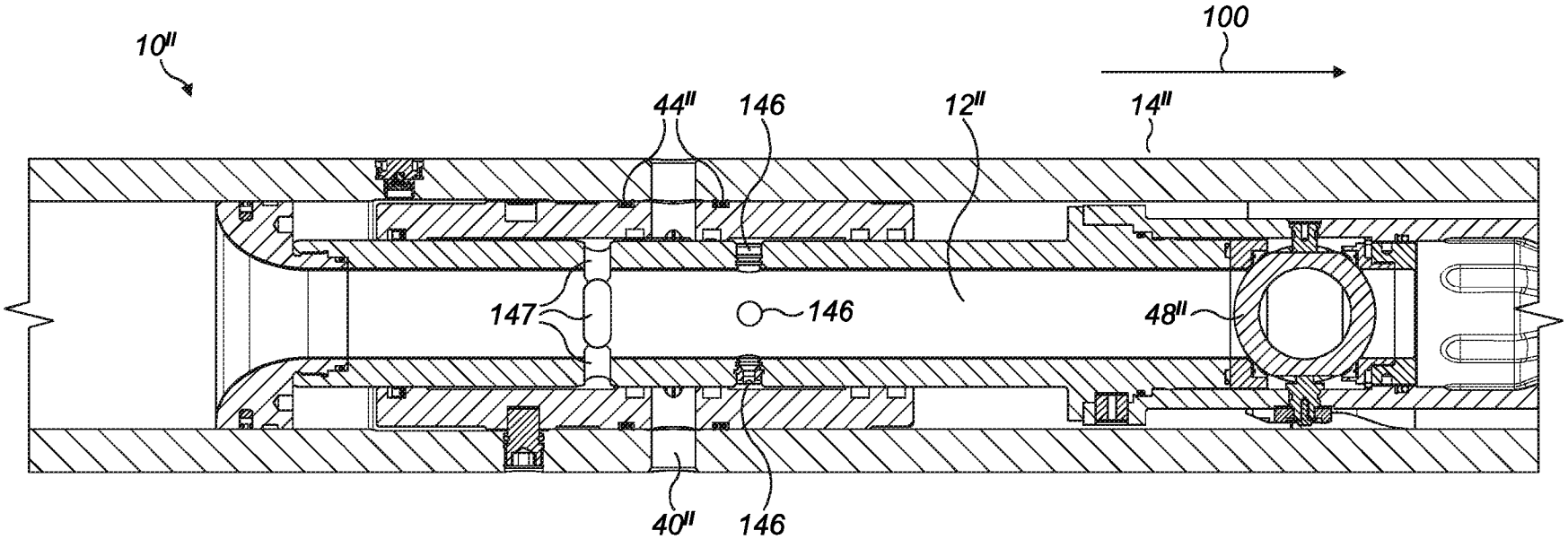
Figure 16:
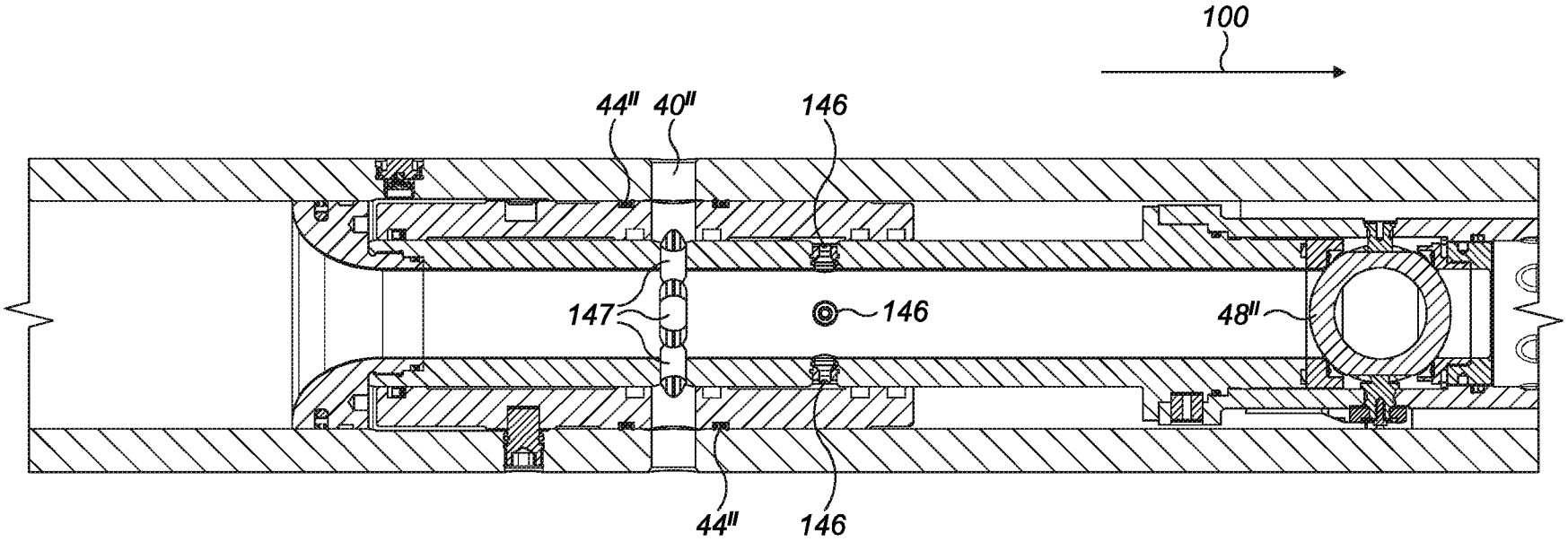
Figure 17:
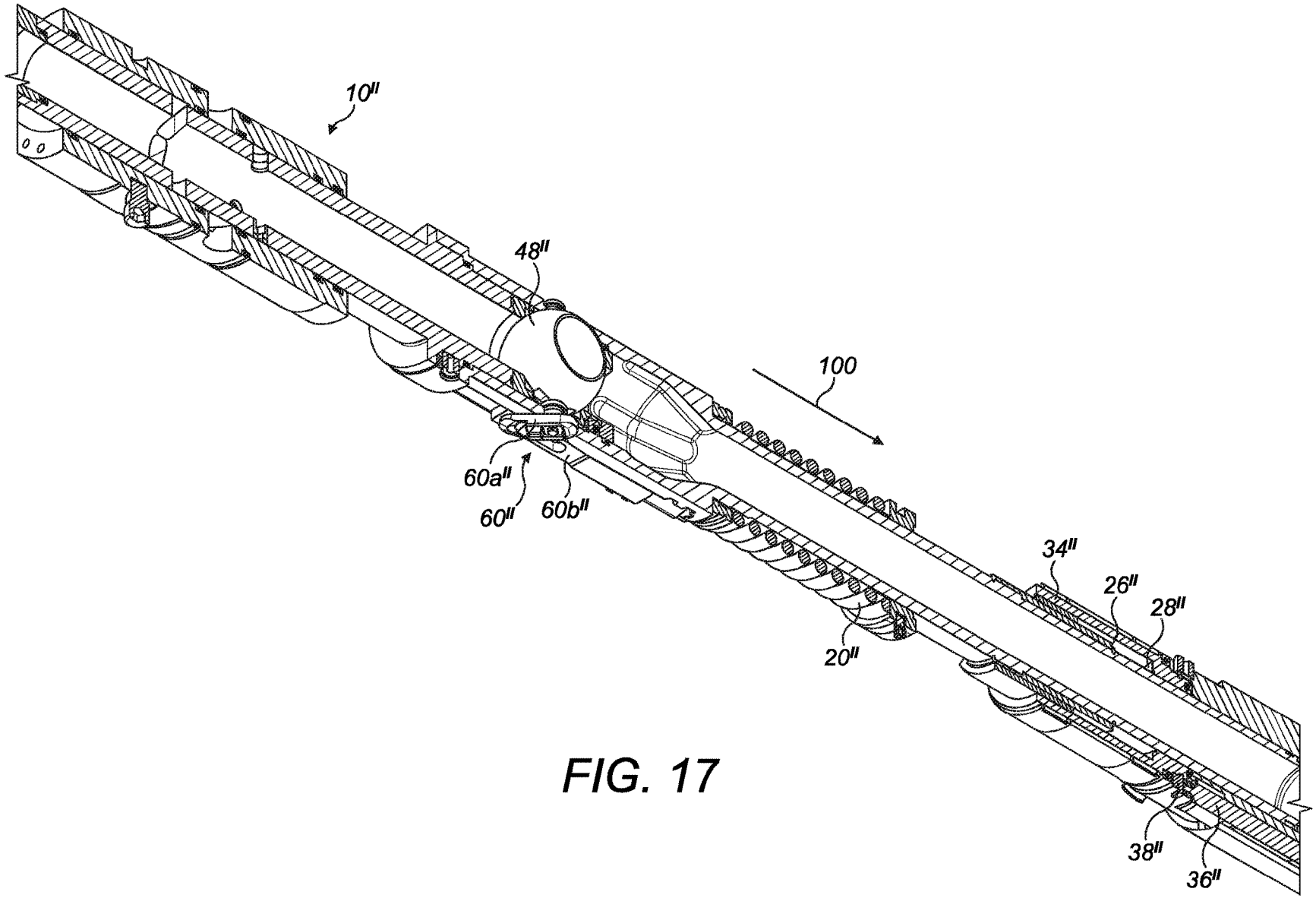

FIGS. 10*a-c* show cross sections through a sliding control arm of a circsub in an embodiment of the present invention;

FIG. 11 shows a controller for controlling an actuator of a circsub in an embodiment of the present invention;

FIG. 12 shows a cross section of a circsub in another embodiment of the present invention when the circsub is in a flow through condition;

FIG. 13 shows a cross section of a circsub in another embodiment of the present invention when the circsub is in a flow through condition;

FIG. 14 shows a cross section of the circsub shown in FIG. 13 when the circsub is in a partial bypass condition;

FIG. 15 shows a cross section of the circsub shown in FIG. 13 when the circsub is in an intermediate position between the partial bypass condition and the full bypass condition;

FIG. 16 shows a cross section of the circsub shown in FIG. 13 when the circsub is in a full bypass condition; and FIG. 17 shows another cross section of the circsub shown in FIG. 13 when the circsub is in the intermediate position between the partial bypass condition and the full bypass condition.

DETAILED DESCRIPTION

Figure 1:
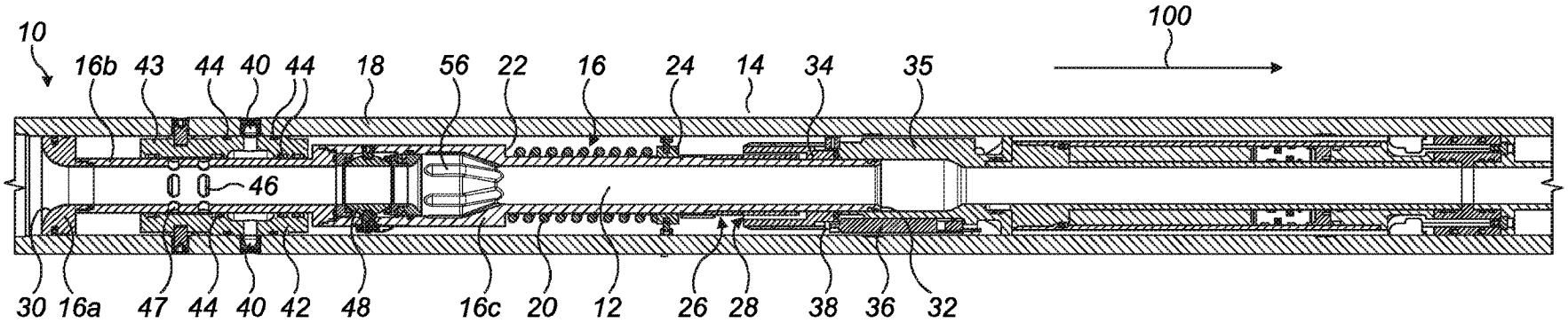
FIG. 1 shows a cross section of a circsub in an embodiment of the present invention when the circsub is in a flow through condition.

FIG. 1 shows a cross sectional view of circsub 10 which is incorporated into a drill string, which comprises a drill pipe above the circsub 10 (not shown) and a bottom hole assembly (not shown) located below the circsub 10. Further drill pipe and other subassemblies may be located between the circsub and the BHA. The drill string shown in FIG. 1 is drilling a horizontal well bore in the direction indicated by arrow 100. Accordingly, the "bottom" of the well bore being drilled in FIG. 1 is actually the rightmost portion of it.

Circsub 10 comprises a piston 16 (which is formed in three parts 16*a*, 16*b*, 16*c* that are rigidly connected together) that is able to slide axially inside drill pipe portion 18. Spring 20 is arranged to engage shoulder 22 of piston 16 and abutment 24, which is rigidly attached to drill pipe portion 18. Spring 20 therefore biases piston 16 up the drill string (i.e. in the opposite direction to that indicated by arrow 100). When the circsub 10 is in use high pressure drilling fluid is typically located in bore 12. The axial force due to the fluid pressure acting on upper end 30 of piston 16 is greater than that acting on lower end 32 of piston 16. This is because the axial component of the surface area of upper end 30, which is sealingly received within the bore of the drill pipe portion 18, is greater than that of lower end 32, which is sealingly received within a motor housing 35, itself fixed in, and sealed to, the drill pipe portion 18. Accordingly, the pressure of the fluid located in bore 12 acts to oppose spring 20.

Figure 5:
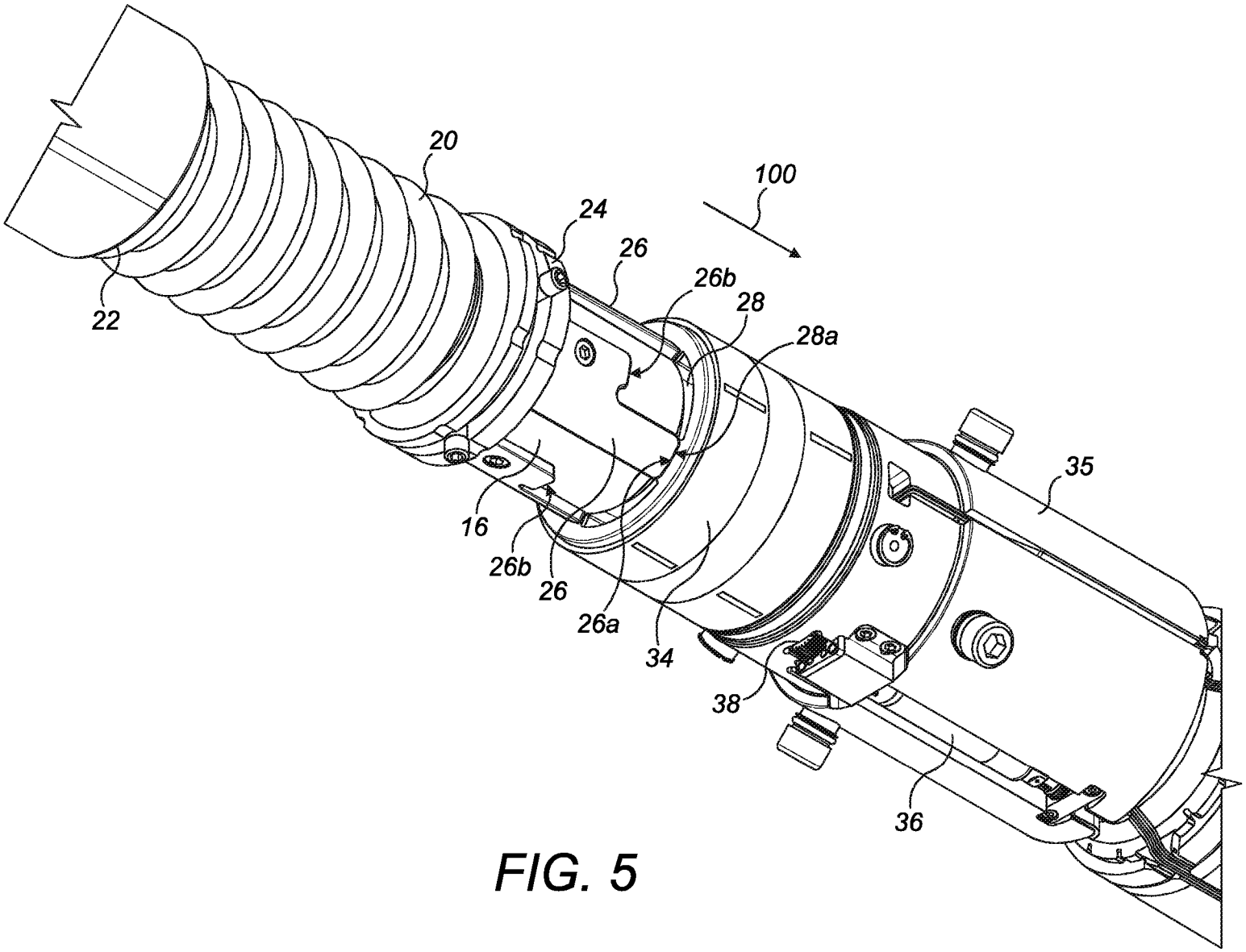
FIG. 5 shows a circsub in an embodiment of the present invention when the circsub is in a flow through condition.

As best illustrated in FIG. 5, if the fluid pressure in bore 12 is sufficient to overcome spring 20 then axial movement of the piston 16 in the direction of arrow 100 is limited by abutment of castellated surfaces 26 on the piston with corresponding castellated surfaces 28 on sleeve 34, which is connected to the motor housing 35, as described further below. The stiffness of spring 20 may be selected so that in normal drilling use the force due to the pressure of the drilling fluid is sufficient to overcome the force applied by the spring.

Sleeve 34 has a circumferentially disposed toothed rack (not easily visible in the drawings) that is engaged by a pinion 38 of a motor 36 (which may have an integral gearbox). Motor 36 is operable to rotate sleeve 34 about the piston 16, thereby to change the angular position of engagement between the castellated surfaces 26, 28. In this respect, it is pointed out that the piston 16, while being free to move axially, is angularly fixed in the drill pipe portion 18. Motor 36 is powered by suitable batteries (not shown) located in circsub 10, and is controlled by controller 80 (see FIG. 11), which controller may also be powered by batteries located in the circsub 10. As will be understood by the skilled person, the batteries used to power motor 36 and controller 80 must capable of operating in the conditions of temperature and pressure that are likely to be encountered when drilling down hole.

In the condition illustrated in FIG. 1 the sleeve 34 is in a first rotational position that does not allow castellated surfaces 26, 28 to interdigitate at all. This causes the castellated surfaces 26, 28 to abut one another before apertures 46, 47 in the piston 16 align with the inlet of nozzle 40. Accordingly, fluid is not able to pass from the bore 12 to the annulus 14, which is a space defined between the outer surface of the circsub 12 and the inner surface of the well bore (not shown). Nozzle 40 is located on sleeve 43, which is bolted to drill pipe portion 18. Annular seals 44 are provided around nozzle 40 to prevent leakage of fluid when apertures 46, 47 are not aligned with the inlet of nozzle 40. A ball valve 48 is provided further down the circsub than apertures 46, 47. In the configuration shown in FIG. 1 the ball valve 48 is in an open condition. The condition illustrated in FIG. 1 is therefore a flow through condition, which allows drilling fluid to flow through the bore 12, and does not allow fluid communication between the bore 12 and the annulus 14.

Figure 2:
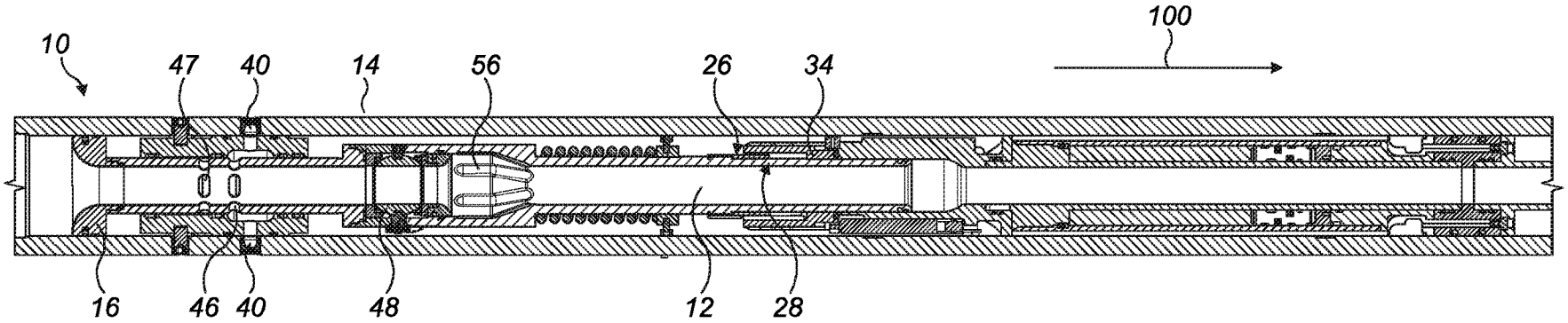
FIG. 2 shows a cross section of a circsub in an embodiment of the present invention when the circsub is in a partial bypass condition.

FIG. 2 shows a cross sectional view of the circsub 10 illustrated in FIG. 1 in a partial bypass condition which allows drilling fluid to flow through the bore 12, but also allows some drilling fluid to pass from the bore 12 to the annulus 14.

In the condition illustrated in FIG. 2 the sleeve 34 has been rotated to a second position, which allows castellated surfaces 26, 28 to partially interdigitate. Accordingly, the movement of piston 16 is limited at an axial position that is further down the drill pipe than was the case in the flow through condition illustrated in FIG. 1. This allows aperture 46 (but not aperture 47) to align with the inlet of nozzles 40. When apertures 46 align with nozzles 40 they provide a conduit between the bore 12 and the annulus 14, so when apertures 46 are aligned with the inlet of nozzles 40 some of the drilling fluid located in the bore 12 is allowed to flow into the annulus 14.

In the condition illustrated in FIG. 2 ball valve 48 remains open, so that fluid can still flow through the bore 12. As will be understood by the skilled person, the degree of opening provided when apertures 46 align with the inlet of nozzles 40 may be selected to provide a desired flow split ratio between the flow in the bore 12 and flow into the annulus 14 when the circsub 10 is in the partial bypass condition.

Figure 3:
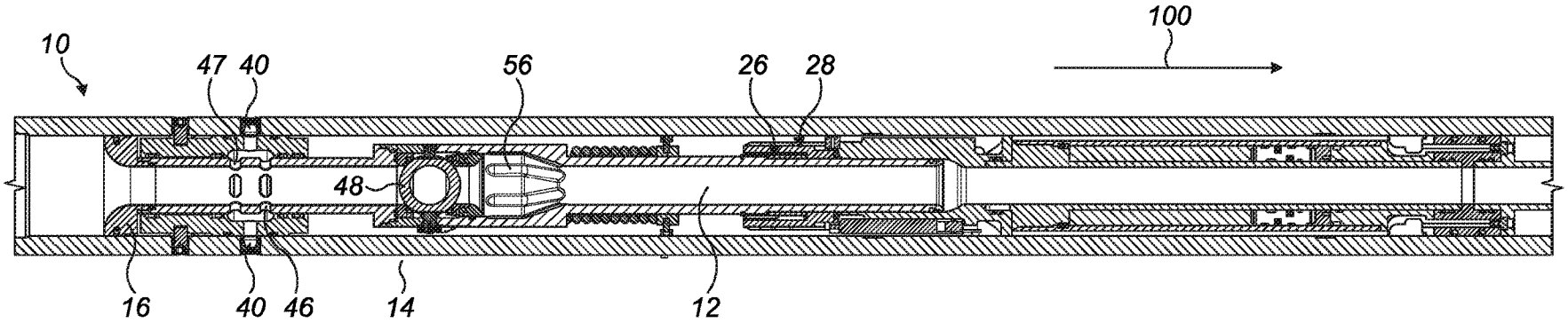
FIG. 3 shows a cross section of a circsub in an embodiment of the present invention when the circsub is in a full bypass condition.

FIG. 3 shows a cross sectional view of the circsub 10 illustrated in FIGS. 1 and 2 in a full bypass condition which prevents drilling fluid from flowing through the bore 12 and allows all of the drilling fluid that flows into the circsub to flow into the annulus 14 via nozzles 40.

In the condition illustrated in FIG. 3 the sleeve 34 is rotated to a third position that allows the castellated surfaces 26, 28 to fully interdigitate. Accordingly, movement of the piston 16 is limited at an axial position that is further down the drill pipe than that shown in FIGS. 1 and 2. This allows both of apertures 46, 47 to align with the inlet of nozzles 40, thereby providing a conduit having an increased surface area compared to the conduit formed by apertures 46 and nozzles 40 in the partial bypass condition shown in FIG. 2. This allows flow of drilling fluid from the bore 12 to the annulus 14 with a lower resistance than the partial bypass condition shown in FIG. 2. In addition to aligning apertures 46, 47 with the inlet of nozzles 40, movement of the piston to the position illustrated in FIG. 3 also causes the ball valve 48 to rotate through 90 degrees to a closed position, thereby preventing flow of fluid through the bore 12. The mechanism by which the ball valve 48 is rotated is described in further detail below, especially with reference to FIGS. 6-10.

Figure 4:
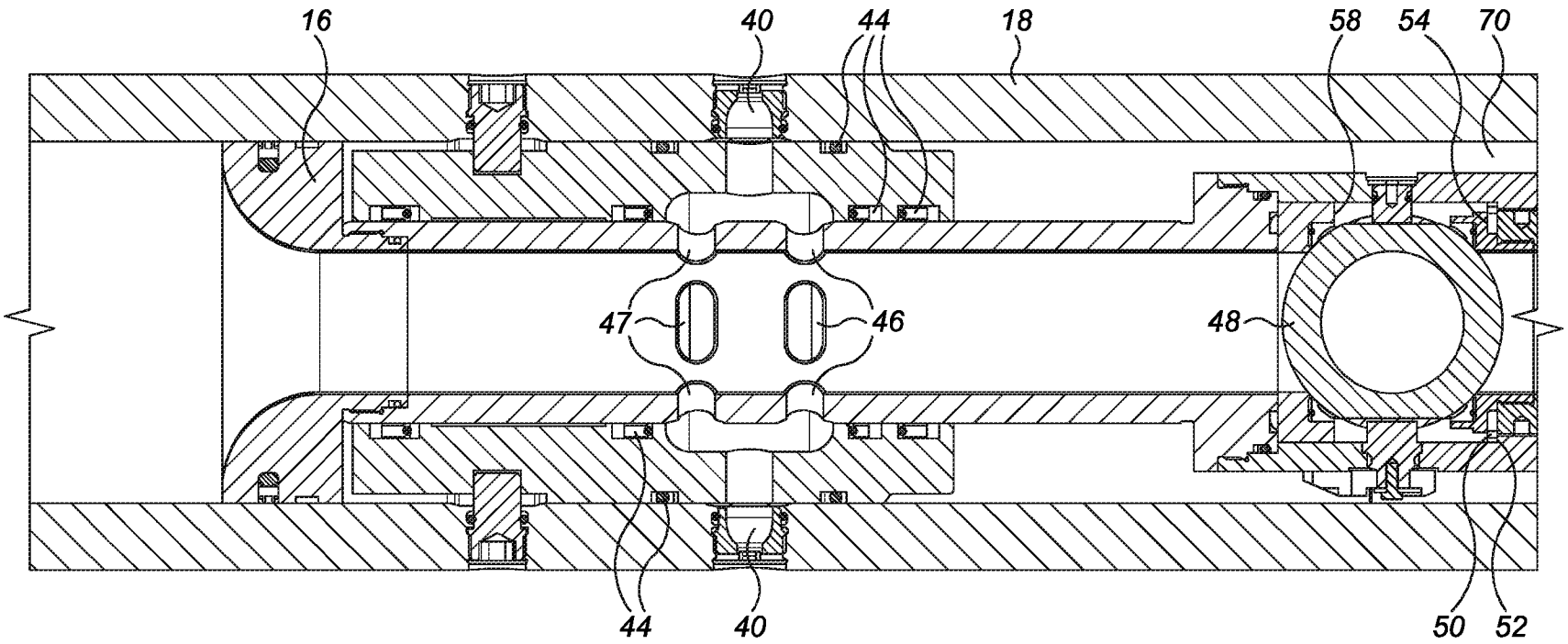
FIG. 4 shows an enlarged version of a portion of the cross section shown in FIG. 3.

FIG. 4 shows an enlarged view of the upper portion of the circsub 10 when it is in the full bypass condition. As can be seen in FIG. 4, the axial position of the ball valve is limited by frangible shear ring 50, which engages shoulder 52 on the inner surface of piston 16 and lower shoulder 54 of the casing of the ball valve 48. In the event that the ball valve 48 becomes stuck in the closed position, or if a blockage prevents a release of fluid pressure that would cause the ball valve to open (because the piston 16 would be biased towards an uppermost position thereof by spring 20, and the ball valve is caused to open when the piston 16 is in the uppermost position), an operator may cause the shear ring 50 to break by increasing the pressure of the drilling fluid to a predetermined level above the normal operating pressure. This causes the ball valve 48 to move in a downward direction (i.e. the direction illustrated by arrow 100) within the piston 16 causing the ball valve 48 to be located in the region of piston 16 that has grooves 56 on the inner surface thereof (see FIG. 3). Upper shoulder of the ball valve cage 58 catches shoulder 52 on the inner surface of the piston. Accordingly, drilling fluid may flow through the cage 58 and around the closed ball valve 48, via grooves 56. This may obviate the need to remove the drill pipe from the well bore if the ball valve 48 becomes stuck in the closed condition.

Turning to FIG. 5, and as mentioned above, a view of circsub 10 when it is in the flow through condition is shown, with drill pipe portion 18 not shown, so as to make the operation of other components visible. When the circsub is in the flow through condition the sleeve 34 is rotated to a first position thereof under the control of motor 36. As can be seen in FIG. 5, when the sleeve 34 is at the first rotational position thereof axial movement of the piston within the drill string is limited by abutment of first portion 26*a* of castellated surface 26 with land 28*a* of castellated surface 28 (castellated surface 28 being located on the sleeve 34, which is axially fixed relative to the drill pipe portion 18). This abutment prevents the apertures 46, 47 from aligning with the inlet of nozzles 40.

If an operator wishes to select the partial bypass condition then they reduce the pressure of the drilling fluid located in bore 12 to a level at which it does not overcome the spring 20. This causes the piston 16 to move in an axially upward direction, so that castellated surfaces 26, 28 no longer abut one another. Once the castellated surfaces 26, 28 no longer abut one another the operator may send a partial bypass signal to controller 80. The controller 80 may comprise a computer readable storage device having machine-readable instructions stored thereon, and a microprocessor. When the controller receives the partial bypass signal it controls the motor 36 to rotate sleeve 34 so that land 28*a* aligns with second portion 26*b* of castellated surface 26. When the pressure in the drilling fluid is increased to its normal operating level so that the force applied by spring 20 is overcome the axial movement of the piston 16 is limited by abutment of the second portion 26*b* of castellated surface 26 with land 28*a*, as shown in FIG. 2. When second portion 26*b* abuts land 28*a* apertures 46 align with the inlet of nozzles 40, thereby allowing some drilling fluid to flow from the bore 12 to the annulus 14.

If an operator wishes to select the full bypass condition, or to re-select the flow through condition, then the procedure is similar to that for selecting the partial bypass condition, but the signal that is sent by the operator after the pressure in the bore 12 has been reduced is a full bypass signal or a flow through signal. Upon receipt of a flow through signal the controller controls the motor so that land 28*a* realigns with first portion 26*a* of castellated surface 26. Upon receipt of a full bypass signal the controller controls the motor to rotate sleeve 34 to a position in which a third portion of castellated surface 26 is aligned with land 28*a*. The third portion of castellated surface 26 is not shown in FIG. 5, but it will be understood that when land 28*a* is aligned with the third portion of castellated surface 26 the castellated surfaces 26, 28 fully interdigitate, as shown in FIG. 3, so that sufficient axial movement of the piston 16 to align both of apertures 46, 47 with the inlet of nozzles 40.

In addition to aligning apertures 46,47 with the inlet of nozzles 40, axial movement of the piston 16 to the position shown in FIG. 3 also causes the ball valve to rotate through 90 degrees from the open position shown in FIG. 2 to the closed position shown in FIG. 3, and as described further below.

The present invention therefore allows an operator to change the condition of a circsub between a flow through condition, a partial bypass condition and a full bypass condition simply by reducing the pressure in the drilling fluid and subsequently sending a signal to the controller to control the motor to rotate the sleeve 34 to the position corresponding to the desired condition. A particular advantage of this method is that it can be actuated relatively quickly, because castellated surfaces 26, 28 do not abut one another when the pressure is reduced, so the resistance to rotation of sleeve 34 is relatively low. Accordingly, the sleeve 34 may be rotated by a relatively small torque, so motor 36 may be provided with a gearbox having only a relatively low gear ratio, which decreases the time required to rotate sleeve 34.

Figure 6:
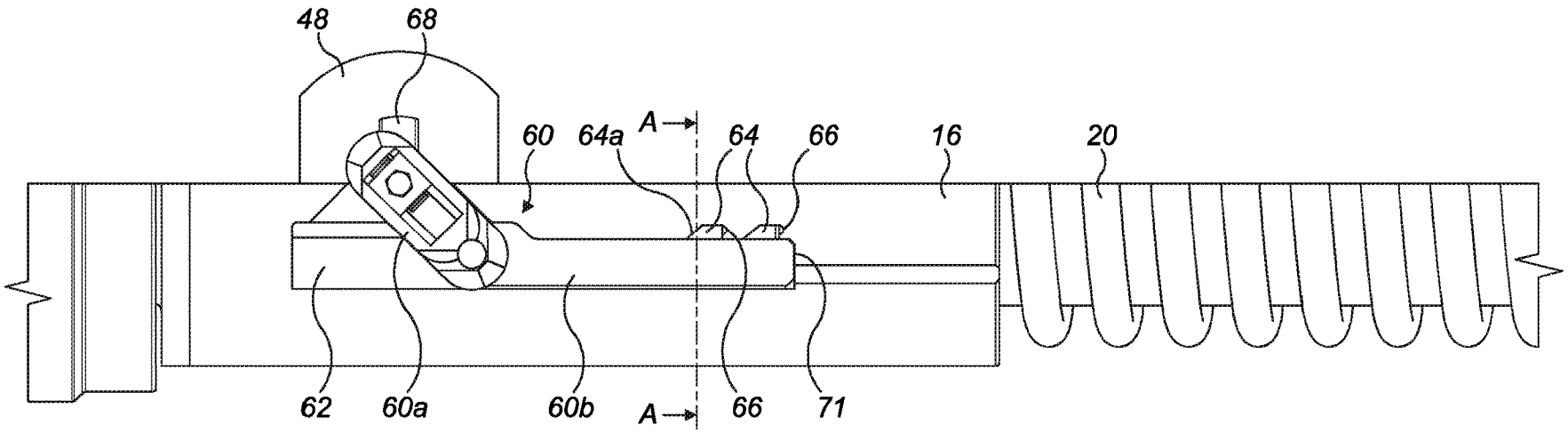
FIG. 6 shows a partial cutaway of a circsub in an embodiment of the present invention when the circsub is in a flow through condition.
Figure 7:
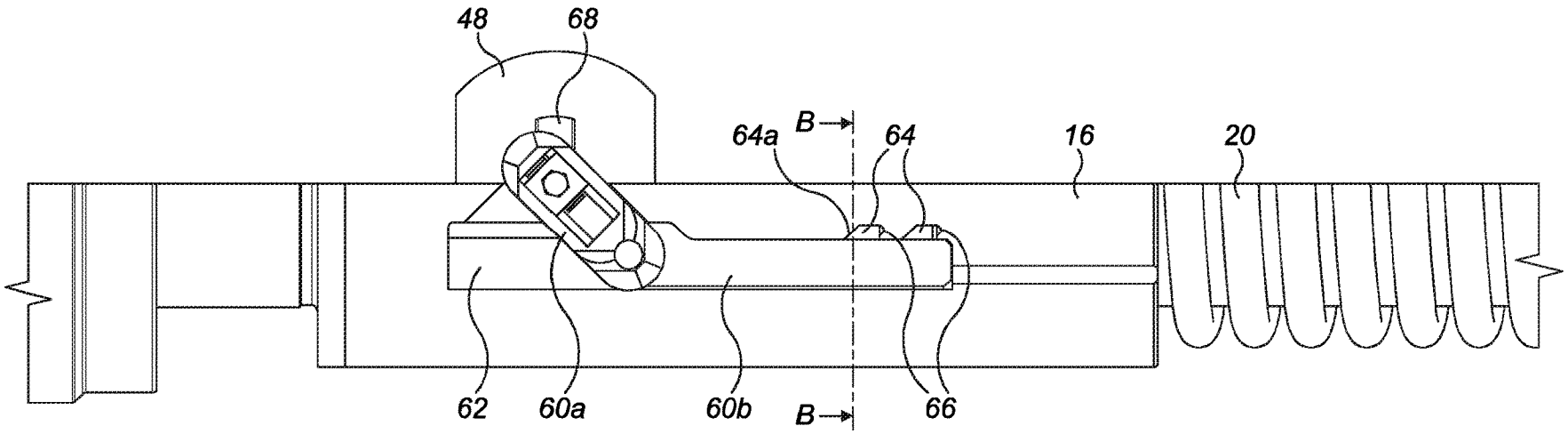
FIG. 7 shows a partial cutaway of a circsub in an embodiment of the present invention when the circsub is in a partial bypass condition.

FIGS. 6-9 shows the operation of the ball valve 48. FIG. 6 shows the configuration of the ball valve when the circsub is in use and the flow through condition is selected. Ball valve 48 is therefore open and allows flow of drilling fluid through bore 12. Ball valve 48 is controlled by a linkage mechanism 60, which comprises a rotatable control arm 60*a* and a sliding arm 60*b*. FIG. 7 shows the configuration of the ball valve 48 when the circsub is in the partial bypass condition. The ball valve shown in FIG. 7 remains open, as was the case in FIG. 6. Indeed, the only difference between FIGS. 6 and 7 is the gradual compression of the return spring 20 as the piston moves rightwardly in the drawings.

Although the transition from the flow through condition to the partial bypass condition causes piston 16 to translate within drill pipe portion 18, there is no action on the sliding control arm 60*b* and it is secured to the piston by keys 64. The keys 64 (actually, there may be just one, single component bearing the keys 64) are mounted for transverse sliding motion in the arm 60*b* through a passage therethrough not visible in FIGS. 6 to 8. The keys 64 are received within recesses 66 in an outer portion of the piston 16. They are prevented, by means described below, from transverse movement in the passage. Accordingly, the linkage mechanism 60 cannot move relative to piston 16, so valve 48 remains in its open condition.

Figure 8:
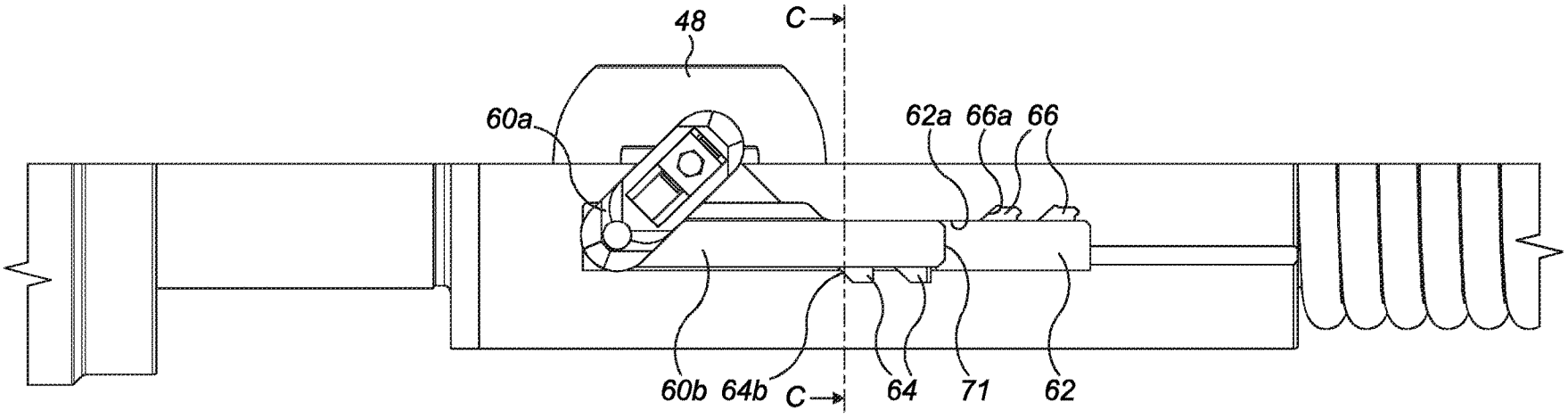
FIG. 8 shows a partial cutaway of a circsub in an embodiment of the present invention when the circsub is in a full bypass condition.
Figure 9:
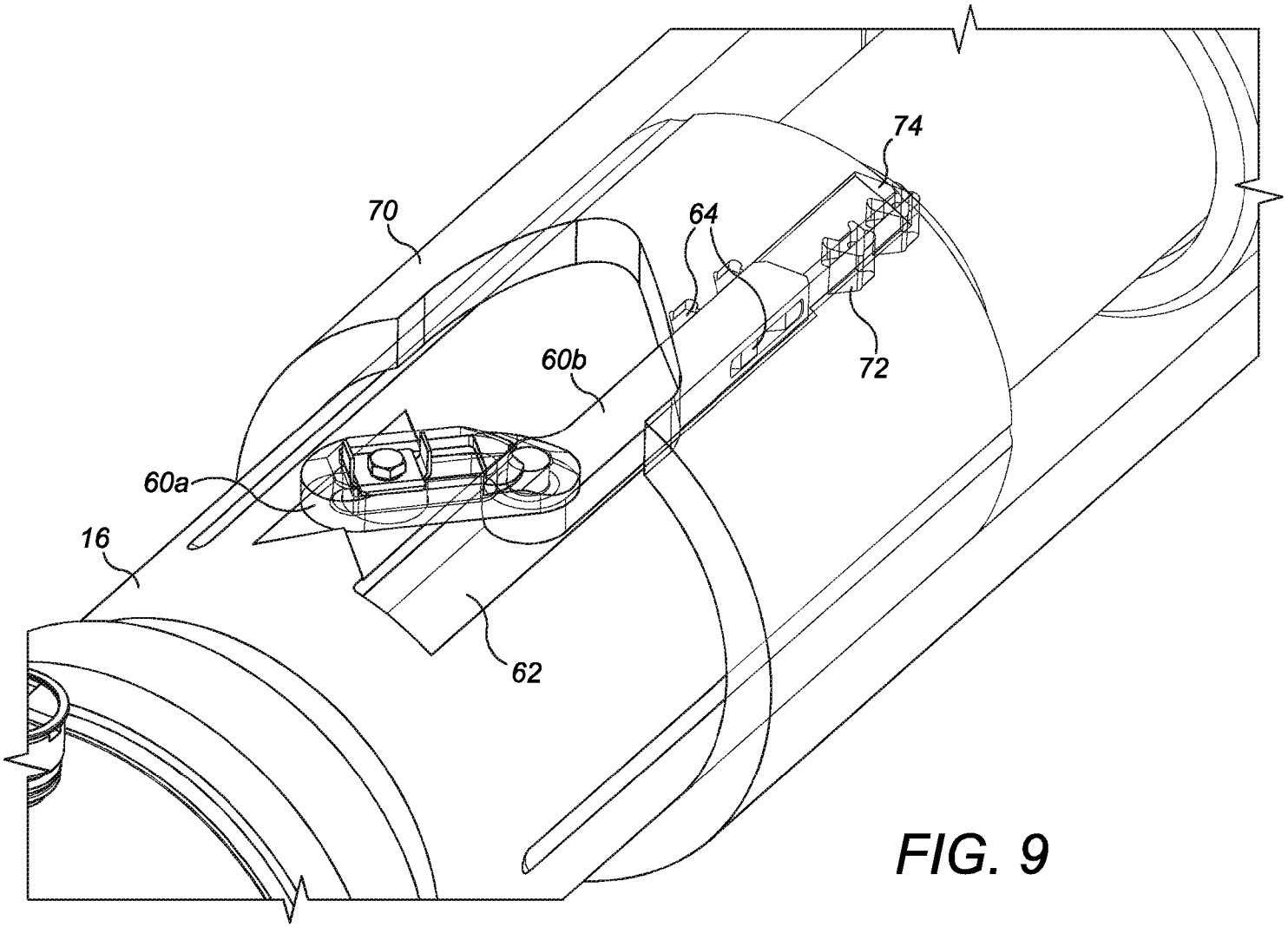
FIG. 9 shows a circsub in an embodiment of the present invention when the circsub is in a flow through condition.

FIG. 8 shows the configuration of the ball valve when the circsub is in the full bypass condition. In this position, sliding control arm has translated along slot 62, which in turn has caused rotating control arm 60*b* to rotate through 90 degrees. This causes the ball valve 48 to rotate through 90 degrees, thereby closing the ball valve. As can be seen in FIG. 8, keys 64 have translated out of recesses 66 in the piston 16 and into recesses 72 in a sleeve 70 (not shown in FIG. 8, but visible in FIGS. 4, 9 and 10*a*-*c*). Sleeve 70 partially surrounds the piston 16 and is rigidly attached to the drill pipe portion 18 (not shown in FIGS. 6-9). As the piston 16 translates between its position in the partial bypass condition shown in FIG. 2 and its position in the full bypass position shown in FIG. 3, recesses 66 and 72 align with one another, thereby allowing the keys 64 to move from recesses 66 into recesses 72. At the same time, end 71 of the control arm is engaged by an internal shoulder (not visible in the drawings) in the sleeve 70. Continued movement of the piston causes the sliding control arm 60*b* to move relative to the piston. Cam surfaces 64*a* on the keys 64 bear against corresponding cam surfaces 66*a* in the recesses 66 to translate the keys sideways, out of engagement with recesses 66 and instead into engagement with recesses 72 in the sleeve, thereby securing the control arm 60*b* to the sleeve 70 rather than to the piston 16, thereby enabling relative movement between the sliding control arm 60*b* and the piston 16.

FIG. 10*a* shows a cross section of the sliding control arm 60*b* and the keys 64 in the flow through condition, along the line A-A in FIG. 6. As can be seen in FIG. 10*a*, key 64 is located inside cross passage 63 in sliding control arm 60*b*. It extends into recess 66. Accordingly, in the configuration shown in FIG. 10*a* the sliding control arm 60*b* can move relative to sleeve 70, but is fixed relative to piston 16. FIG. 10*b* shows a cross section along the same portion of the sliding control arm 60*b*, along the line B-B in FIG. 7, after the piston has moved inside the sleeve 70 to a position at which recesses 72 are aligned with recesses 66. This occurs either when the piston 16 is in the partial bypass position illustrated in FIG. 2, or when it is in transition from the full bypass position back to the flow through condition. As can be seen in FIG. 10*b*, key 64 has space to move across from recess 66 into recess 72, but has not yet moved out of recess 66.

Movement of the piston 16 into the full bypass position illustrated in FIG. 3, causes the end 71 of the sliding control arm 60*b* to abut the shoulder in the sleeve 70 and ultimately cause the key 64 to move from recess 66 into recess 72, because the angled leading edges 64*a* (shown in FIGS. 6 and 7) act as cams against the recess faces 66*a* and force the key 64 into recess 72 as the control arm is moved along the groove 62. Once the keys 64 are moved into the recesses 72, the ends of the cams 64*a* rub along wall 62*a* of the groove 62, so that the sleeve 70 and control arm 60*b* act as one and close the valve 48 on continued movement of the piston.

When the piston moves from the full bypass position illustrated in FIG. 3 to the partial bypass position illustrated in FIG. 2, the keys 64 locked in the sleeve recesses 72 pull the control arm back along the groove 62 until the ball valve is fully open. At this point, the ends of the cams 64 align again with the recesses 66. Thus the angled leading edges 64*b* (shown in FIG. 8) act as cams against corresponding surfaces of the recesses 72 to force key 64 from recess 72 into recess 66. Thereafter, the control arm is locked to the piston and continued movement of the piston to the flow through position does not affect the ball valve further.

Thus, the arrangement of the ball valve allows the ball valve to be automatically opened or closed when the piston moves between the partial bypass and the full bypass positions, with no change to the state of the ball valve when the piston moves between the flow through and partial bypass positions.

FIG. 11 shows a controller 80 for controlling motor 36. The controller 80 comprises electronic memory 82, which has computer readable instructions stored thereon, and microprocessor 84.

In some embodiments the controller 80 may be operable to receive signals by various known methods, including receipt of electronic signals from a user interface that is located at surface level when the circsub is in operation.

In the embodiment shown in FIG. 11 the controller 80 is connected to a plurality of sensors 86, 88, 90, which sensors are located in the circsub 10. Sensor 86 is a proximity sensor to detect the position of piston 16 relative to sleeve 34. The controller 80 is configured to only initiate rotation of motor 36, thereby rotating the sleeve 34, when the piston 16 is in a position that would not cause castellated surfaces 26 to come into contact with castellated surfaces 28 as the sleeve 34 is rotated.

Sensor 88 is a pressure sensor configured to sense the pressure within the bore 12. The controller 80 is configured to only initiate rotation of sleeve 34 when the detected pressure is sufficiently low that the spring 20 is able to move the piston 16 to a position at which castellated surfaces 26 would not come into contact with castellated surfaces 28 during rotation of the sleeve 34.

The sensor array may additionally include a temperature sensor (not shown) to determine whether the temperature is within the range that it is safe to change the condition of the circsub 10, and may be used to shut down the microprocessors if temperatures exceed a predetermined threshold above which they may be damaged by continued operation. Additionally, the controller could be used to control certain temperature dependent characteristics of electronic devices such as motor 36 or the batteries that power it based on the measured temperature.

Sensor 90 comprises a plurality of accelerometers, which accelerometers are configured to monitor acceleration in the circsub 10 along three mutually perpendicular axes. The accelerometers 90 may provide an indication of whether the drill pipe is currently drilling, and the controller may be configured not to initiate rotation of sleeve 34 whilst the drill pipe is drilling.

The accelerometers may also be used to detect mechanical signals that may be sent down the drill pipe by an operator, which may allow the condition of the circsub 10 to be changed without the necessity for an electrical connection to the surface. For example, when the outputs from the proximity sensor 86, the pressure sensor 88 and optionally the temperature sensor all indicate that movement of the sleeve 34 is possible, the controller 80 may enter a "listening mode" in which it is operable to receive three different predetermined mechanical signals via accelerometers 90, which mechanical signals each indicate a condition of the circsub 10 that the operator wishes to transition to. The mechanical signals may, for example, comprise sequences of rotation of the drill pipe at predetermined rotational velocities for predetermined time periods. The sequences may comprise sequences of axial movements of the drill pipe. In some embodiments, the controller 80 may be connected to a compression sensor, and the signals may comprise sequences of compressions of the drill string. In some embodiments the circsub 10 to be operable by at least two different types of mechanical signal that are measured by different sensors, thereby providing some redundancy in the operation of the circsub 10.

Although the embodiments described above include a motor 36 to rotate sleeve 34, it will be understood that other actuators would also be suitable. For example, hydraulics may be used to actuate the rotation of sleeve 34 by providing one or more valves that are controllable by the controller 80 instead of motor 36. Such valves may be solenoid valves that are operable to allow or prevent flow of pressurised fluid into one or more actuation channels. The pressurised fluid may be drilling fluid from bore 12.

FIG. 12 shows a circsub 10' in an alternative embodiment of the present invention. Many of the components of circsub 10' are similar to the components of the circsub shown in FIGS. 1-11. Similar components will be indicated by the same reference numerals with a superscript dash (').

Circsub 10' is shown in a "flow through" condition thereof in FIG. 12, with ball valve 48' open and apertures 46', 47' in the piston 16' not aligned with apertures 40' in the drill pipe portion 18'. The direction of flow of drilling fluid through the bore 12' of circsub 10' is indicated by arrow 100 and the piston 16 comprises two parts **16*a*' and 16*b*'** that are rigidly connected together.

Movement of the piston 16 is controlled in a similar manner to the piston 16 illustrated in FIGS. 1-11. Spring 20' biases the piston in an upward direction within drill pipe portion 18, but when the circsub 10' is in use the drilling fluid located in bore 12' causes hydraulic pressure to act on the upper surface of piston 16 and surface 53, thereby biasing the piston 16' down the drill pipe portion 18. It will be noted that apertures 49 have been provided in piston 16 to allow drilling fluid to access cavity 51, which is partly defined by surface 53. The stiffness of the spring 20' is chosen so that the force applied by the spring 20' is overcome by the force due to hydraulic pressure when the drilling fluid located in bore 12' is at the operating pressure used when drilling. In the configuration shown in FIG. 12 the piston 16' is prevented from moving any further down drill pipe portion 18' by the abutment of castellated surfaces 26', 28'.

The circsub 10' may be changed to a partial bypass condition by rotating sleeve 34' via motor 36' and pinion 38' so that castellated surfaces 26', 28' may partially interdigitate. The pressure of the drilling fluid in the bore 12' is reduced before rotating sleeve 34', so that spring 20' forces the piston 16' up the drill pipe portion 18 to a position in which castellated surfaces 26', 28' no longer abut one another. Rotation of sleeve 34' allows piston 16' to move sufficiently to allow apertures 46' (but not apertures 47') to align with the inlet of apertures 40', thereby forming a conduit between the bore 12' and the annulus 14' located outside the drill pipe portion 18'. In this condition ball valve 48' remains open, so drilling fluid may still flow through bore 12'.

The circsub 10' may be changed to a full bypass condition by rotating sleeve 34' to a position in which castellated surfaces 26', 28' fully interdigitate. When the circsub 10' is in this condition and the pressure of the drilling fluid in the bore 12' is increased sufficiently to overcome spring 20' apertures 46' and 47' align with the inlet of apertures 40', and a lever mechanism that is actuated by movement of the piston 16' causes ball valve 48' to close, thereby preventing flow of drilling fluid through bore 12.

The ball valve 48' is located by a frangible shear ring 50', and is configured to move down the drill pipe so that it is located within grooves 56' if the frangible shear ring brakes. This allows drilling to continue if the mechanism of the ball valve sticks.

An advantage of the embodiment shown in FIGS. 1-11 over the embodiment shown in FIG. 12 is that the distance between the ball valve 48, 48' and the apertures 46, 47, 46', 47' that allow drilling fluid to flow from the bore 12, 12' when the circsubs are in the full bypass condition is reduced in the embodiment shown in FIGS. 1-11. The full bypass condition may be used when an operator wishes to pump lost circulation material (LCM) into the annulus, for example to stop drilling fluid from being lost into the formation through cracks in the well bore. Before the circsub is taken out of the full bypass condition drilling fluid without LCM may be pumped through the bore 12 to prevent the BHA from being exposed to excessive amounts of LCM when the ball valve is opened. However, this may not remove LCM from the space between the ball valve 48, 48' and the apertures 46, 47, 46', 47'. Accordingly, it is desirable for the apertures to be as close to the ball valve as possible so that the space that cannot be cleared of LCM is as small as possible.

FIGS. 13-17 show a circsub in another embodiment of the present invention. Many of the components of the circsub shown in FIGS. 13-17 are the same as those shown in FIGS. 1-11. Similar components will be indicated by the same reference numerals with a superscript double dash (").

FIG. 13 shows circsub 10" in a flow through condition, with ball valve 48" open and piston 16" positioned within drill pipe portion 18" such that none of apertures 146, 147 are located within annular seals 44". Fluid communication between the bore 12" and the annulus 14" is therefore not allowed. Accordingly, when in the configuration shown in FIG. 13 circsub 10" only allows fluid to flow directly through bore 12".

FIG. 14 shows circsub 10" in a partial bypass condition, in which ball valve 48" is open and apertures 146 are located between annular seals 44" and are aligned with nozzle 40". A transition between the flow through condition shown in FIG. 13 and the partial bypass condition shown in FIG. 14 may be actuated in a similar manner to the corresponding transition in the embodiment shown in FIGS. 1-11. Specifically, the pressure within annulus 12" may be reduced so that spring 20" moves piston 16" up drill string portion 18". This moves castellated surface 26" which is attached to piston 16" (not shown in FIG. 14 but visible in FIG. 17) out of engagement with a corresponding castellated surface 28", which is attached to a rotatable sleeve (also visible in FIG. 17) that is axially fixed within drill pipe portion 18". The rotatable sleeve may then be rotated to a position that allows the castellated surfaces 26", 28" to partially interdigitate so that downward movement (i.e. movement in the direction indicated by arrow 100) of the piston 16" relative to drill pipe portion 18" is limited to the position shown in FIG. 14. The rotation of the rotatable sleeve may be controlled by an electric motor 36" and controller similar to that shown in FIG. 11.

FIG. 16 shows circsub 10" in a full bypass condition, in which ball valve 48" is closed and apertures 147 are aligned with nozzles 40". Accordingly flow through the annulus 12" is prevented and all of the fluid that arrives at the upper portion of the circsub 10" flows into the annulus via apertures 147 and nozzles 40". It will be understood that apertures 147 provide a lower resistance to fluid flow than apertures 146 in the embodiment illustrated in FIGS. 13-17. This causes the resistance to flow between the bore 12" and the annulus 14" to be lower in the full bypass condition, in which apertures 147 align with nozzles 40", than it is in the partial bypass condition, in which apertures 146 align with nozzles 40". It will be understood that the resistance to flow between the bore 12" and the annulus 14" when the circsub 10" is in the partial bypass condition may be tuned to produce a desired flow split between flow in the annulus and flow through bore 12".

A transition between the partial bypass condition and the full bypass condition may be actuated in a similar way to the corresponding transition in the embodiment shown in FIGS. 1-11.

FIGS. 15 and 17 show circsub 10" in an intermediate position between the partial bypass condition shown in FIG. 14 and the full bypass condition shown in FIG. 16. In the position shown in FIGS. 15 and 17 the ball valve 48" is closed and apertures 146, 147 are located outside annular seals 44" and are not aligned with nozzles 40". Accordingly, fluid cannot flow through bore 12" and fluid communication between the bore 12" and the annulus 14" is prevented. Pumping further fluid into the circsub 10" therefore causes the piston to move in the direction illustrated by arrow 100. Accordingly, the amount of fluid power required to move piston 16" between the partial bypass and full bypass conditions is reduced, because there is no requirement to drive flow in the annulus 14" or through the bore 12" as the piston 16" is moving between the partial bypass and full bypass conditions.

It will be understood that FIG. 15 merely shows the piston 16" as it moves between the partial bypass and flow through conditions, not at a stable configuration. Accordingly, no engagement of the castellated surfaces 26", 28" occurs at the intermediate position, as best seen in FIG. 17.

An additional benefit of the arrangement shown in FIGS. 13-17 is that a clear pressure pulse can be observed by the operator when the piston 16" arrives at the full bypass condition and the apertures 147 align with the nozzles 40". Accordingly, an operator may have increased confidence that the tool has changed condition and the probability that the operator starts pumping lost circulation material (LCM) before the tool is in the full bypass condition is reduced. This may be important, because the bottom hole assembly (BHA) may be damaged if it comes into contact with LCM.

The ball valve is arranged to become fully closed at the intermediate position illustrated in FIGS. 15 and 17. Accordingly, the position of the linkage mechanism 60", which is arranged to operate in a similar manner to the linkage mechanism 60 illustrated in FIGS. 6-10, is selected to ensure that the closure of the ball valve is completed at the intermediate position illustrated in FIGS. 15 and 17, rather than at the full bypass position illustrated in FIG. 16.

In the embodiments described above a selectively adjustable abutment is provided by a rotatable sleeve having a castellated surface with three different abutment positions. However, it will be understood that a castellated surface having only two positions, one corresponding to a flow through condition and one corresponding to a full bypass condition, could also be provided. Furthermore, a selectively adjustable abutment that defines more than three positions, for example a castellated surface having more than three different abutment positions, could also be provided. This may allow a circsub of the present invention to have a plurality of partial bypass conditions, with the conduit that connects the bore of the circsub to the annulus open to a different extent in each of the plurality of partial bypass conditions. Indeed, a cam surface could be provided instead of a castellated surface, with the two extreme positions of the cam surface corresponding to the full bypass condition and the flow through condition respectively, and the intermediate positions corresponding to partial bypass conditions. In this way the extent to which the conduit between the annulus and the bore is open can be controlled by controlling the position of the cam surface. Accordingly, the degree of opening of the conduit may be substantially continuously variable.

Although the above embodiments allow a user to effect changes in the condition of the circsub by sending mechanical signals to an electronic controller once the pressure within the circsub is reduced below a threshold value, it will be understood that other ways of effecting transitions would also be suitable. In a modified embodiment compared to that shown in FIGS. 1-11, the sleeve 34 may be rotated through a predetermined angle by a barrel cam whenever the pressure in the bore 12 is reduced sufficiently for piston 16 to be moved up the drill pipe portion to its uppermost position. In this way the circsub may be cycled between conditions by repeatedly decreasing the pressure below the threshold value and increasing the pressure above the threshold value. A down-hole tool in which a castellated surface is rotated through a predetermined angle each time the pressure in the bore is reduced below a threshold value is disclosed in EP1161615 B1.

Within the context of present application the terms "up", "down", "upper", "lower", "top", "bottom" and variations thereof are relative to the direction of drilling. Accordingly, it will be understood that the "bottom" of a drill string is the part of the drill string that is located furthest into the earth, at which a drilling tool (often referred to as a bottom hole assembly) is likely to be located, and the "top" of a drill string is the portion that is located at the surface. This convention applies to horizontal well bores and well bores with an upward component as well as well bores with a downward component and vertical well bores.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. A circulation subassembly (circsub) for incorporation in a drill pipe, the circsub comprising a piston movable within a bore of the circsub in a first axial direction by pressure of fluid within said bore, the piston having:

a first axial position corresponding to a flow through condition of the circsub in which the circsub allows fluid to flow through a bore of the circsub and does not allow fluid flow from the bore of the circsub through bypass orifices in the circsub into an annulus located outside the drill pipe;

a second axial position corresponding to a partial bypass condition of the circsub in which the circsub allows fluid to flow through the bore of the circsub and allows fluid communication through said bypass orifices from the bore of the circsub into the annulus; and a third axial position corresponding to a full bypass condition of the circsub in which the circsub does not allow fluid to flow through the bore of the circsub and allows fluid communication through said bypass orifices from the bore of the circsub into the annulus, wherein the circsub further comprises biasing means for biasing the piston in a second axial direction opposite to the first axial direction, and a selectively adjustable abutment for limiting the movement of the piston in said first axial direction to each of said first, second and third axial positions.

2. The circsub as claimed in claim 1 and further comprising an electronic controller and an actuator operable to move the adjustable abutment, the controller being operable:

in response to receipt of a first signal, to control the actuator to move the adjustable abutment so as to stop movement of the piston when the piston is in the first axial position;

in response to receipt of a second signal, to control the actuator to move the adjustable abutment so as to stop movement of the piston when the piston is in the second axial position; and in response to receipt of a third signal, to control the actuator to move the adjustable abutment so as to stop movement of the piston when the piston is in the third axial position.

3. The circsub as claimed in claim 2, wherein the controller is powered by a power source that is separate from surface level when the circulation subassembly is in use in a drill pipe.

4. The circsub as claimed in claim 3, wherein the actuator comprises one or more controllable valves operable to move the adjustable abutment by allowing or preventing flow of pressurised fluid into one or more actuation channels.

5. The circsub as claimed in claim 2, wherein the adjustable abutment comprises a first castellated surface and a second castellated surface, one of which is defined on the piston, wherein the actuator is configured to move the first castellated surface relative to the second castellated surface, thereby to effect the transitions between the flow through condition, the partial bypass condition and the full bypass condition.

6. The circsub as claimed in claim 5, wherein the adjustable abutment comprises a sleeve on which the first castellated surface is defined, wherein movement of the first castellated surface comprises rotation of the sleeve.

7. The circsub as claimed in claim 6, wherein the actuator comprises a motor configured to rotate the sleeve.

8. The circsub as claimed in claim 2 wherein the circsub further comprises a first sensor in communication with the controller, the first sensor being configured to detect mechanical signals transmitted through the drill pipe from surface level, wherein the first, second and third signals correspond to predetermined mechanical signals being detectable by said first sensor.

9. The circsub as claimed in claim 8, wherein the first sensor comprises one or more accelerometers.

10. The circsub as claimed in claim 8 wherein the first signal corresponds to a first predetermined mechanical signal being received when the circsub is in the full bypass condition, the second signal corresponds to a second predetermined mechanical signal being received when the circsub is in the flow through condition and the third signal corresponds to a third predetermined mechanical signal being received when the circsub is in the partial bypass condition.

11. The circsub as claimed in claim 2, wherein the circsub further comprises a pressure sensor in communication with the controller, the pressure sensor being configured to detect a pressure in the bore of the circsub, wherein the controller is configured to prevent transitions between the flow through, partial bypass and full bypass conditions when the pressure measured by the pressure sensor is above a first threshold value.

12. The circsub as claimed in claim 2, wherein the circsub further comprises a proximity sensor in communication with the controller, the proximity sensor being configured to detect a position of a piston of the circsub, wherein the controller is configured to prevent transitions between the flow through, partial bypass and full bypass conditions in dependence on the position of the piston.

13. The circsub as claimed in claim 1, wherein the adjustable abutment is configured to be automatically moved once the pressure falls below a threshold value.

14. The A circsub as claimed in claim 13, further comprising a barrel cam and follower which causes relative rotation between the adjustable abutment and the piston when the pressure of fluid in the circsub rises and falls below the threshold value.

15. The circsub as claimed in claim 1, wherein the biasing means comprises a spring.

16. The circsub as claimed in claim 1, wherein the circsub comprises a valve having an open condition in which flow through the bore of the circsub is allowed and a closed condition in which flow through the bore of the circsub is substantially prevented, wherein the valve is configured to assume the open condition when the circsub is in the flow through condition or the partial bypass condition and to assume the closed condition when the circsub is in the full bypass condition.

17. The circsub as claimed in claim 16, wherein the valve is a ball valve.

18. The circsub as claimed in claim 16, wherein the valve is located within the circsub by a frangible abutment, wherein the frangiable abutment is configured to break when the valve is in the closed condition and the pressure in the bore of the circsub is greater than a second threshold value, the valve being configured to move within the circsub to a position at which drilling fluid may flow around the valve when the frangible abutment breaks.

19. The circsub as claimed in claim 18, wherein the frangible abutment comprises a frangible shear ring.

20. The circsub as claimed in claim 18, wherein grooves are provided on an inner surface of the bore, said grooves being configured to facilitate movement of drilling fluid around the ball valve when the ball valve has moved to the position at which drilling fluid may flow around the ball valve.

21. The circsub as claimed in claim 16, wherein the valve is configured to assume the closed condition when the piston is at an intermediate position between the partial bypass position and the full bypass position.

22. The circsub as claimed in claim 1, wherein said bypass orifices comprise a first set of one or more bypass orifices, a second set of one or more bypass orifices and a third set of one or more bypass orifices, wherein:

when the piston is in the second axial position the first set of bypass orifices and not the second set of bypass orifices are aligned with the third set of bypass orifices, thereby allowing fluid communication between the bore and the annulus;

when the piston is in the third axial position the second set of bypass orifices and not the first set of bypass orifices are aligned with the third set of bypass orifices, thereby allowing fluid communication between the bore and the annulus.

23. The circsub as claimed in claim 22, wherein the first set of orifices and the second set of orifices are located in the piston and the third set of orifices are located in an outer body of the circsub.

24. The circsub as claimed in claim 1, wherein said bypass orifices comprise one or more bypass orifices located in said piston and one or more bypass orifices located in an outer body of the circsub, wherein the bypass orifices located in said piston at least partially overlap the bypass orifices in the outer body when the piston is in said second and third axial positions.

25. The circsub as claimed in claim 1, wherein the resistance to fluid flow between the bore and the annulus when the piston is in the second axial position is greater than the resistance to fluid flow between the bore and the annulus when the piston is in the third axial position.

26. A method of operating a circsub as claimed in claim 1, wherein transitions between the flow through, partial bypass and full bypass conditions are effected by sequentially:

reducing the pressure of fluid within said bore to a value at which the piston no longer abuts the adjustable abutment;

moving the selectively adjustable abutment; and increasing the pressure to a value at which further movement of the piston is limited by the piston abutting the adjustable abutment.

27. A circulation subassembly (circsub) for incorporation in a drill pipe, the circsub comprising a valve assembly as claimed in claim 1, wherein the sleeve is a bore of the circsub and the piston is movable within a bore of the circsub in a first axial direction by pressure of fluid within said bore, wherein the first axial position of the piston corresponds to a flow through condition of the circsub in which the circsub allows fluid to flow through a bore of the circsub and does not allow fluid flow from the bore of the circsub through bypass orifices in the circsub into an annulus located outside the drill pipe;

the second axial position of the piston corresponds to a partial bypass condition of the circsub in which the circsub allows fluid to flow through the bore of the circsub and allows fluid communication through said bypass orifices from the bore of the circsub into the annulus; and the third axial position of the piston corresponds to a full bypass condition of the circsub in which the circsub does not allow fluid to flow through the bore of the circsub and allows fluid communication through said bypass orifices from the bore of the circsub into the annulus, wherein the circsub further comprises biasing means for biasing the piston in a second axial direction opposite to the first axial direction, and a selectively adjustable abutment for limiting the movement of the piston in said first axial direction to each of said first, second and third axial positions.

28. A valve assembly for controlling flow of fluid through a bore of a piston, the assembly comprising a valve having a first condition and a second condition, an actuation assembly for changing the valve between the first condition and the second condition, the piston, and a sleeve in which the piston is located, wherein:

the piston is movable to a first axial position, a second axial position and a third axial position relative to the sleeve, the second axial position being between the first and third axial positions;

when the piston is moved from the second axial position to the third axial position the actuation assembly causes the valve to change from the first condition to the second condition;

when the piston is moved from the third axial position to the second axial position the actuation assembly causes the valve to change from the second condition to the first condition; and the actuation assembly does not change the condition of the valve when piston is moved from the second axial position to the first axial position or from the first axial position to the second axial position, wherein the first condition is an open condition in which the valve allows fluid to flow through the bore of the piston and the second condition is a closed condition in which the valve does not allow fluid to flow through the bore of the piston.

29. The valve assembly as claimed in claim 28, wherein the valve is a ball valve.

30. The valve assembly as claimed in claim 28, wherein the movement of the piston relative to the sleeve comprises translation.

31. The valve assembly as claimed in claim 28, wherein the actuation assembly comprises a control arm and a key, wherein:

movement of the control arm relative to the piston causes the valve to change between the first condition to the second condition;

when the piston is in the first axial position or the second axial position the key is located between a recess in the control arm and a recess in the piston, thereby preventing relative movement between the control arm and the piston;

movement of piston from the second axial position to the third axial position causes the key to move within the recess in the control arm to a position in which the key is located between the recess in the control arm and a recess in the sleeve and subsequently causes the control arm to move relative to the piston; and movement of piston from the third axial position to the second axial position causes the control arm to move relative to the piston and subsequently causes the key to move within the recess in the control arm to a position in which the key is located between the recess in the control arm and the recess in the piston.

32. The valve assembly as claimed in claim 31, wherein the key has one or more cam surfaces, which cam surfaces are configured to cause the key to move within the recess in the control arm when the piston is moved between the second axial position and the third axial position.

33. A circulation subassembly (circsub) for incorporation in a drill pipe, the circsub comprising a piston movable within a bore of the circsub in a first axial direction by pressure of fluid within said bore, the piston having:

a first axial position corresponding to a flow through condition of the circsub in which the circsub allows fluid to flow through a bore of the circsub and does not allow fluid flow from the bore of the circsub through bypass orifices in the circsub into an annulus located outside the drill pipe;

a second axial position corresponding to a partial bypass condition of the circsub in which the circsub allows fluid to flow through the bore of the circsub and allows fluid communication through said bypass orifices from the bore of the circsub into the annulus; and a third axial position corresponding to a full bypass condition of the circsub in which the circsub does not allow fluid to flow through the bore of the circsub and allows fluid communication through said bypass orifices from the bore of the circsub into the annulus, wherein the circsub further comprises biasing means for biasing the piston in a second axial direction opposite to the first axial direction, and a selectively adjustable abutment for limiting the movement of the piston in said first axial direction to each of said first, second and third axial positions;

wherein the circsub comprises a valve having an open condition in which flow through the bore of the circsub is allowed and a closed condition in which flow through the bore of the circsub is substantially prevented, wherein the valve is configured to assume the open condition when the circsub is in the flow through condition or the partial bypass condition and to assume the closed condition when the circsub is in the full bypass condition; and wherein the valve is located within the circsub by a frangible abutment, wherein the frangiable abutment is configured to break when the valve is in the closed condition and the pressure in the bore of the circsub is greater than a second threshold value, the valve being configured to move within the circsub to a position at which drilling fluid may flow around the valve when the frangible abutment breaks.

* * * * *